US009273430B2

(12) United States Patent
Hilker

(10) Patent No.: US 9,273,430 B2
(45) Date of Patent: Mar. 1, 2016

(54) WEB TURN-UP CUTTING APPARATUS AND METHOD

(71) Applicant: PAPRIMA INDUSTRIES INC., Dorval (CA)

(72) Inventor: Dieter H Hilker, Mascouche (CA)

(73) Assignee: PAPRIMA INDUSTRIES INC., Dorval, QC, CA (US)

( * ) Notice: Subject to any disclaimer, the term of this patent is extended or adjusted under 35 U.S.C. 154(b) by 0 days.

(21) Appl. No.: 14/375,474

(22) PCT Filed: Jan. 28, 2013

(86) PCT No.: PCT/CA2013/050056

§ 371 (c)(1),
(2) Date: Jul. 30, 2014

(87) PCT Pub. No.: WO2013/113110

PCT Pub. Date: Aug. 8, 2013

(65) Prior Publication Data

US 2015/0007957 A1 Jan. 8, 2015

Related U.S. Application Data

(63) Continuation of application No. 13/490,747, filed on Jun. 7, 2012, now Pat. No. 8,628,641.

(60) Provisional application No. 61/592,545, filed on Jan. 30, 2012.

(51) Int. Cl.
*D21F 11/00* (2006.01)
*D21F 7/04* (2006.01)
(Continued)

(52) U.S. Cl.
CPC ..... *D21F 7/04* (2013.01); *B65H 19/265* (2013.01); *D21F 7/006* (2013.01); *B65H 2301/41414* (2013.01); *B65H 2301/51534* (2013.01)

(58) Field of Classification Search
USPC ..... 162/195, 194, 286
IPC ..... D21F 11/00
See application file for complete search history.

(56) References Cited

U.S. PATENT DOCUMENTS 5,314,132 A 5/1994 Ando et al.
5,782,426 A 7/1998 Kinnunen et al.
(Continued)

FOREIGN PATENT DOCUMENTS

CA 2354303 A1 1/2003
CA 2258533 C 4/2005
(Continued)

OTHER PUBLICATIONS

PCT/CA2013/050056 international preliminary report.
(Continued)

*Primary Examiner* — Mark Halpern
(74) *Attorney, Agent, or Firm* — Anglehart et al.

(57) ABSTRACT

A web turn-up cutting method and apparatus for severing a continuous web has a water jet controller adapted to activate a water supply of first and second water nozzles and a carriage controller adapted to actuate the nozzle carriages to provide a transversal movement of the first and second water nozzles. The first and second nozzles are adapted to define together a substantially X-shaped cut on the traveling continuous web defining at least a substantially V-shaped tail for ending a forming roll, an opposite substantially V-shaped start for starting a new spool, a detachable first wing and a detachable second wing.

19 Claims, 38 Drawing Sheets

(51) Int. Cl.

| | |
|---|---|
| ***B65H 19/26*** | (2006.01) |
| ***D21F 7/00*** | (2006.01) |

(56) References Cited

U.S. PATENT DOCUMENTS

| | | | |
|---|---|---|---|
| 6,135,000 | A | 10/2000 | Caspar et al. |
| 6,464,161 | B1 | 10/2002 | Kaipf |
| 6,709,549 | B2 | 3/2004 | Berglund et al. |
| 6,863,238 | B1 | 3/2005 | Kojo et al. |
| 2011/0083795 | A1 | 4/2011 | Kowalewski et al. |

FOREIGN PATENT DOCUMENTS

| | | | |
|---|---|---|---|
| DE | 69620089 | T2 | 8/2002 |
| DE | 10309049 | A1 | 9/2004 |
| DE | 202004009144 | U1 | 9/2004 |
| DE | 10343448 | A1 | 4/2005 |
| EP | 0997417 | A1 | 5/2000 |
| WO | WO 97/48632 | A1 | 12/1997 |
| WO | WO 2004/110910 | A1 | 12/2004 |

OTHER PUBLICATIONS

PCT/CA2013/050056 international search report with related claims 1-28.

WEB TURN-UP CUTTING APPARATUS AND METHOD

This application is a 371 of PCT/CA2013/050056 filed 28 Jan. 2013.

TECHNICAL FIELD

The present invention relates to a web cutting apparatus of a papermaking machine and, in particular, to a web cutting apparatus for transferring a continuous web from a forming roll to a new spool.

BACKGROUND

The manufacturing of paper has evolved over the last centuries. Modern papermaking began in the early 19$^{th}$ century in Europe with the development of the Fourdrinier machine, consisting in the production of a continuous roll of paper rather than individual sheets. With the aim of reducing paper making manufacturing costs, the papermaking machine has further evolved and is capable of forming at very high speeds (i.e. around 100 km/h), a large band of paper web typically measuring up to 11 meters wide. At a final step of the paper making process, the continuous paper web is wound as a roll that is used in post-processing or distribution of paper.

The papermaking process is a continuous process which cannot be readily started and stopped without incurring considerable expense. Therefore, the rolls of paper which are formed must be started and cut off from the continuously formed web without interrupting the continuous production of paper.

When the roll is fully formed, the continuous paper web is severed and redirected onto a new spool. It is common practice to use a web cutting apparatus for cutting or notching the continuous paper web so as to form a tail end and a turn-up start for assisting in the re-threading of the web from a forming roll to a new spool. As the web travels at a very high speed, the web cutting apparatus must produce a cut of the web for effectively re-threading the new spool without causing a jam in the machine and interrupting production.

In PCT patent application No. PCT/US97/07615 to Beloit Technologies inc., there is disclosed a web turn-up apparatus that uses two water jets and an adhesive material dispenser such as a tape or glue dispenser. The two water jets are oriented to cut the web as it is led over a winder drum. The jets are initially positioned above the web at a center portion and each jet travels toward an opposite edge portion of the web. The two jets form a turn-up start having substantially a V-shape. The dispenser applies the adhesive material onto the turn-up start so as to provide an instant engagement of the start with the new spool, thereby assuring thereon a tight, uniform and consistent initiation of the web.

In European patent application No. EP0997417 to Voith Paper Patent GmbH, there is disclosed a method and device for severing a running web. A cutter unit is movable relative to the plane of the web and is positioned at an underside of the web. In one example, there is a cutter unit with a single cutter, the cutter is adapted to travel from one edge of the web to the opposite edge. As the web is being wound onto the forming reel, the cutter produces an oblique cut line across the web. In another example, the cutter unit has two cutters, the cutters are each adapted to travel from a center portion of the web toward opposite edges. There is presented the cut lines produced by each of the cutters as the web is being wound onto the forming reel, the cut lines cross at a middle portion and extend toward the opposite edges of the web.

In U.S. Pat. No. 6,135,000 to Paprima Industries Inc., there is disclosed a water jet cutting apparatus mounted on a beam. The beam spans across the web and is transversal to the travel direction of the web. The cutting apparatus has water jet nozzles located on opposite sides of the beam. In one example, each jet is adapted to travel along the beam from a middle portion of the beam toward an outer portion of the beam forming a pointed start on the web. Paprima further presents the cut lines formed by each water jet, as the web travels the water jets initially positioned above a middle portion form cut lines that cross and extend to opposite edges of the web. In yet another example, there is a single water jet that travels from one edge of the web to an opposite edge of the web. A skilled person would understand that with such displacement of the water jet, as the web travels there would be formed an oblique start.

As presented in FIGS. 1A and 1B, the cutting apparatus in the above mentioned references form either a pointed start 100*a* or an oblique cut start 100*b* for re-threading around a new spool and form respectively a complementary notched tail 102*a* or an oblique cut tail 102*b* for the forming spool.

The web portions (100*a* and 102*a*) of FIG. 1A, each travel at high speed in the direction indicated by the arrow, an adhesive being placed on the pointed start 100*a* causes this web portion to tightly engaging a new spool. However, the notched tail 102*a* is a loose end that has a tendency to uncontrollably flutter as it is pulled around the forming spool. The uncontrolled fluttering of the notched tail 102*a* can cause a rip and/or a complete detachment of a portion of the notched tail 102*a* thereby possibly jamming the papermaking machine, disrupting further processing operations as pieces of paper get wrapped in the forming roll and causing production loss.

In FIG. 1B, the oblique cut start 100*b* and tail 102*b* both have a shape that is possibly less prone to uncontrollably flutter as it is pulled around the forming spool. However, the complementary oblique cut start 100*b* may cause alignment problems when re-threading a new spool. The shape of an oblique cut start 100*b* is such that at re-threading, as the prominent edge of the web engages the new spool, a pulling force is initially applied only at that prominent edge. A pulling force being applied at only one edge portion does not provide a symmetric pulling force across the web, thereby possibly causing web edge alignment problems and wrinkles on the forming roll and this can be a cause for production loss.

Therefore, there is a need for a web cutting apparatus that forms a web tail portion for ending a forming spool and a web start portion for re-threading a new spool that are stable when traveling at high speed. Also there is a need for a web cutting apparatus that forms a web start portion for re-threading a new spool in a uniform edge alignment.

SUMMARY

Applicant has discovered that it is possible in a paper making machine to perform a turn-up cut of a high speed traveling paper web by defining a shaped tail for ending a forming roll and also a shaped start for starting a new spool which are both shaped to remain effectively stable after the cut.

According to one aspect there is a web turn-up cutting apparatus for severing a continuous web that is traveling at very high speed in a travel direction. The speed of the traveling web can differ from one paper making machine to another, in common paper making machines, the web travels at speeds as high as 2000 meters per minute.

The web turn-up cutting apparatus comprises a first and second nozzles that are each connectable to a respective water supply hose and adapted to produce a respective water cutting jet. The nozzles are each mountable on a respective nozzle carriage and are transversely movable with respect to the travel direction of the web.

The web turn-up cutting apparatus further comprises a jet controller and a carriage controller. The jet controller is adapted to activate a water supply of each water supply hose to produce with the first and second nozzles a respective water cutting jet. The carriage controller is adapted to actuate the nozzle carriages to provide a transversal movement of the first and second nozzles.

Together, the first and second nozzles are adapted to define a substantially X-shaped cut on the traveling continuous web. The substantially X-shaped cut defines at least a substantially V-shaped tail for ending a forming roll, an opposite substantially V-shaped start for starting a new spool, a detachable first wing and a detachable second wing.

According to one embodiment, the nozzle controller is adapted to actuate the nozzle carriages to provide a transversal movement of the first and second nozzles from a respective edge of the continuous web to a middle portion of the continuous web and from the middle portion of the continuous web back to the respective edge of the continuous web.

In one example of this embodiment, each nozzle carriage is actuated to cross the continuous web from edge to edge. The second nozzle is positioned upstream from the first nozzle and the nozzle controller is adapted to actuate a first nozzle carriage to provide a transversal movement of the first nozzle from a first edge of the continuous web to a middle portion thereof and from the middle portion to a second edge of the continuous web. Simultaneously, the nozzle controller is adapted to actuate a second nozzle carriage to provide a transversal movement of the second nozzle from the second edge of the continuous web to a middle portion thereof and from the middle portion to the first edge of the continuous web, the second edge being opposite to the first edge.

In an alternate example of this embodiment, each nozzle carriage is actuated to cross only up to a middle portion of the continuous web and cross back to a respective edge of the continuous web and. The nozzle controller is adapted to actuate the first nozzle carriage to provide a transversal movement of the first nozzle from the first edge of the continuous web to a middle portion thereof and from the middle portion back to the first edge of the continuous web.

Simultaneously, the nozzle controller is adapted to actuate the second nozzle carriage to provide a transversal movement of the second nozzle from the second edge of the continuous web to a middle portion thereof and from the middle portion back to the second edge of the continuous web, the second edge being opposite to the first edge.

According to another embodiment, the web turn-up cutting apparatus is further adapted to form a detachable middle strip. There is a second nozzle that is positioned upstream from a first nozzle and the nozzle controller is adapted to actuate the nozzle carriages to provide a transversal movement of the first and second nozzles for defining respectively a first cut line and a second cut line that cross in the middle portion of the continuous web. The first cut line and the second cut line cross at a first middle portion point and at a second middle portion point, wherein the first middle portion point is upstream from the second middle portion point. The detachable middle strip being defined by the first cut line and the second cut line between the first and second middle portion points.

According to another embodiment, the web turn-up cutting apparatus is a further adapted to form a single center cut line. The nozzle controller is adapted to actuate the nozzle carriages to provide a transversal movement of a first nozzle and of a second nozzle for creating respectively a first cut line and a second cut line that join in the middle portion of the continuous web. The single center cut line being defined by the joining of the first and the second cut lines.

According to another embodiment, the web turn-up cutting apparatus is further adapted to define a middle strip connecting the substantially V-shaped tail and the substantially V-shaped start. The nozzle controller is adapted to actuate the nozzle carriages to provide a transversal movement of a first nozzle and of a second nozzle for creating respectively a first cut line and a second cut line that remain separate in the middle portion of the continuous web, thereby forming the middle strip.

In an alternate embodiment, the web turn-up cutting apparatus comprises an adhesive applicator that is adapted to apply an adhesive on at least a portion of the middle strip and allow the at least portion of the middle strip to adhere on a winding surface of the new spool thereby causing the substantially V-shaped tail to sever from the continuous paper web for ending the forming roll.

According to another embodiment, the web turn-up cutting apparatus comprises an adhesive applicator. The adhesive applicator is adapted to apply an adhesive on at least a portion of the substantially V-shaped tail and allow the V-shaped tail to adhere on a winding surface of the forming roll as the substantially V-shaped tail is wound thereon.

In an alternate embodiment, the adhesive applicator is further adapted to apply an adhesive on at least a portion of the substantially V-shaped start and allow the V-shaped start to adhere on a winding surface of the new spool as the substantially V-shaped start is wound thereon.

According to another embodiment, the web turn up cutting apparatus comprises a wing adhesive applicator. The wing adhesive applicator is adapted to apply an adhesive on at least a portion of the first and the second detachable wings and allow the first and second detachable wings to engageably adhere to a driving drum of the papermaking machine and detach from the continuous paper web.

According to another embodiment, the carriage controller is adapted to actuate the nozzle carriages to provide a transversal movement of the nozzles, whereby the nozzles define together the substantially X-shaped cut on the traveling continuous web in less then 1 to 3 seconds.

According to another embodiment, the carriage controller is adapted to actuate each of the nozzle carriages from an initial position to a final position for defining with the nozzles the substantially X-shaped cut, wherein the final position is a subsequent initial position for performing a subsequent substantially X-shaped cut.

According to another aspect there is a method of performing a turn-up in a paper making machine. The method comprises defining a substantially X-shaped cut in a traveling continuous paper web. The substantially X-shaped cut forming at least a substantially V-shaped tail for ending a forming roll, an opposite substantially V-shaped start for starting a new spool, a detachable first wing and a detachable second wing. The method further comprises detaching the detachable first wing and the detachable second wing from the traveling continuous paper web. The method further comprises distancing the substantially V-shaped tail from the substantially V-shaped start by allowing the substantially V-shaped start to engage a new spool.

According to one embodiment, the method of performing a turn-up further comprises applying an adhesive on at least a portion of the traveling continuous paper web.

In one alternative, the adhesive is applied so that following the defining of the substantially X-shaped cut, there is adhesive on at least the detachable first wing and the detachable second wing.

The adhesive may allow the detachable first and second wings to engage a surface of a driving drum of the papermaking machine and detach from the continuous web as a respective detached first wing and a respective detached second wing. The method may further comprise removing the detached first wing and the detached second wing from the surface of the driving drum. The removal of the detached first and second wings may be done in various ways, one way is to remove the wings by scraping a surface of the driving drum.

In another alternative, the adhesive is applied so that following the defining of the substantially X-shaped cut, there is adhesive applied on the substantially V-shaped start, thereby allowing the substantially V-shaped start to engage the new spool.

In the embodiment in which the substantially X-shaped cut forms a middle strip that connects the V-shaped tail and the V-shaped start, the method may further comprise applying an adhesive on at least a portion of the middle strip. As the applied adhesive on the at least portion of the middle strip contacts the new spool, the middle strip severs and this allows the at least portion of the middle strip and the connected V-shaped start to engage the new spool.

According to one embodiment, the defining the substantially X-shaped cut is made in accordance with a method of controlling nozzle carriages as further described below.

According to another aspect there is a method of controlling nozzle carriages in a web turn-up cutting apparatus of a paper making machine. The nozzle carriages are adapted to provide a transversal movement to a respective first nozzle and second nozzle with respect to a traveling direction of a paper web.

The method comprises positioning a first nozzle carriage near a first edge portion of the paper web and positioning a second nozzle carriage near a second edge portion of the paper web.

The method further comprises displacing the first nozzle carriage from near the first edge portion of the paper web to near a center portion of the paper web and defining at least in-part a V-shaped tail for ending a forming roll and in-part a first detachable wing, when a water supply to the first nozzle is activated. In addition, method comprises displacing the second nozzle carriage from near the second edge portion of the paper web to near a center portion of the paper web and defining at least in-part the V-shaped tail and in-part a second detachable wing, when a water supply to the second nozzle is activated.

The method further comprises moving one of the first and second nozzle carriage from near the center portion of the paper web to near the first edge portion of the paper web and defining at least in-part a V-shaped start for re-threading a new spool and in-part one of the first and second detachable wings, when a water supply to the respective nozzle is activated. In addition, method comprises moving another one of the first and second nozzle carriage from near the center portion of the paper web to near the second edge portion of the paper web and defining at least in-part the V-shaped start end and in-part another one of the first and second detachable wings, when a water supply to the respective nozzle is activated.

According to one embodiment, each carriage is adapted to move back to its respective originating edge. In the method, the moving one of the first and second nozzle carriage is the moving of the first nozzle carriage from near the center portion of the paper web to near the first edge portion of the paper web and the moving another one of the first and second nozzle carriage is the moving of the second nozzle carriage from near the center portion of the paper web to near the second edge portion of the paper web.

According to another embodiment, each carriage is adapted to cross over the width of the paper web. In the method, the moving one of the first and second nozzle carriage is the moving of the second nozzle carriage from near the center portion of the paper web to near the first edge portion of the paper web and the moving another one of the first and second nozzle carriage is moving of the first nozzle carriage from near the center portion of the paper web to near the second edge portion of the paper web.

According to another embodiment, the carriages are adapted to displace the nozzles so as to define at least a center portion cut line. In the method, the displacing the first nozzle carriage and the second nozzle carriage comprises aligning the first nozzle carriage and the second nozzle carriage at an alignment line near the center portion of the paper web. The displacing thereby defines at least a center portion cut line and in-part the first and second detachable wings.

In one alternative, the carriages are adapted to displace the nozzles so as to define a detachable middle strip. In the method, the displacing the first nozzle carriage and the second nozzle carriage further comprises displacing the first nozzle carriage and the second nozzle carriage beyond the alignment line while remaining near the center portion of the paper web. The displacing thereby defines two center portion cut lines and forms a detachable middle strip.

According to another embodiment, the carriages are adapted to displace the nozzles so as to define a middle strip that connects the V-shaped tail and the V-shaped start. In the method, the displacing the first nozzle carriage and the second nozzle carriage comprises maintaining a distance between the first nozzle carriage and the second nozzle carriage near the center portion of the paper web. This displacing thereby forms a middle strip that connects the V-shaped tail and the V-shaped start.

According to another aspect there is a machine-readable data storage medium. The machine-readable data storage medium comprises machine-executable instructions for controlling a definition of a substantially X-shaped cut in a traveling continuous paper web of a papermaking machine. The substantially X-shaped cut forms at least a substantially V-shaped tail for ending a forming roll, an opposite substantially V-shaped start for starting a new spool, a detachable first wing and a detachable second wing. The controlling is made in accordance with the method of controlling the nozzle carriages as described above.

According to yet another aspect there is a method of manufacturing paper in a papermaking machine. The method comprises producing a continuous web of paper, displacing the continuous web of paper in a predetermined travel direction and winding the continuous web of paper around a forming roll. The method further comprises performing a turn-up as defined above, positioning a new spool near the forming roll, accelerating a rotation of the new spool up to a winding speed and threading the turn-up around the new spool. In addition, the method comprises ending the winding of the continuous web of the paper around the forming roll as a formed roll, displacing the formed roll away from the new spool and decelerating a rotation of the formed roll until a full stop. Paper made using the turn-up technique of the embodiments described herein is typically of a reduced cost and/or of better quality due to the benefits of the improved turn-up technique.

BRIEF DESCRIPTION OF THE DRAWINGS

The invention will be better understood by way of the following detailed description of embodiments of the invention with reference to the appended drawings, in which.

DETAILED DESCRIPTION

Figure 1A:
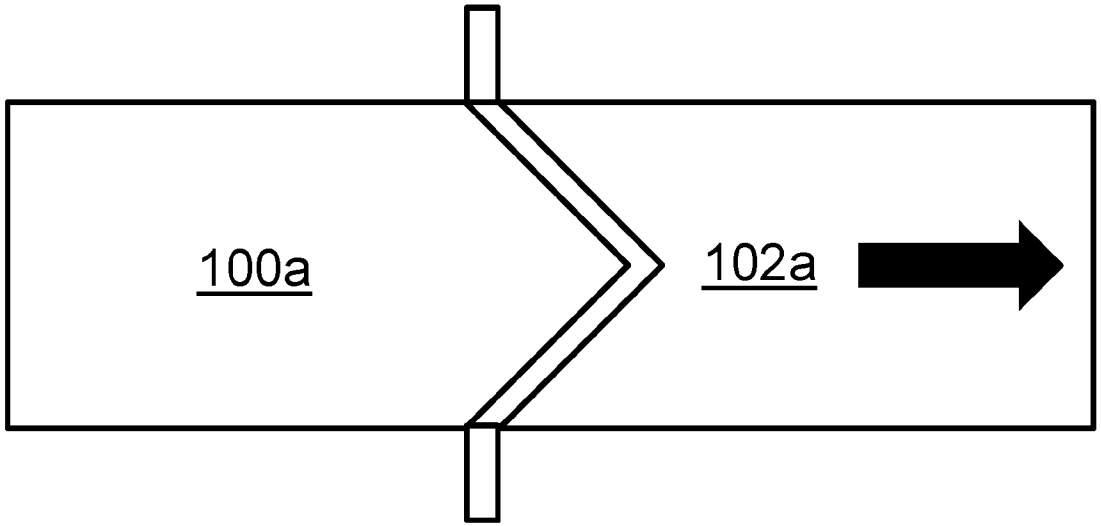
FIG. 1A PRIOR ART
FIG. 1A presents a diagram of a severed paper web having a pointed start and a notched tail defined by a prior art turn-up cutting apparatus.
Figure 1B:
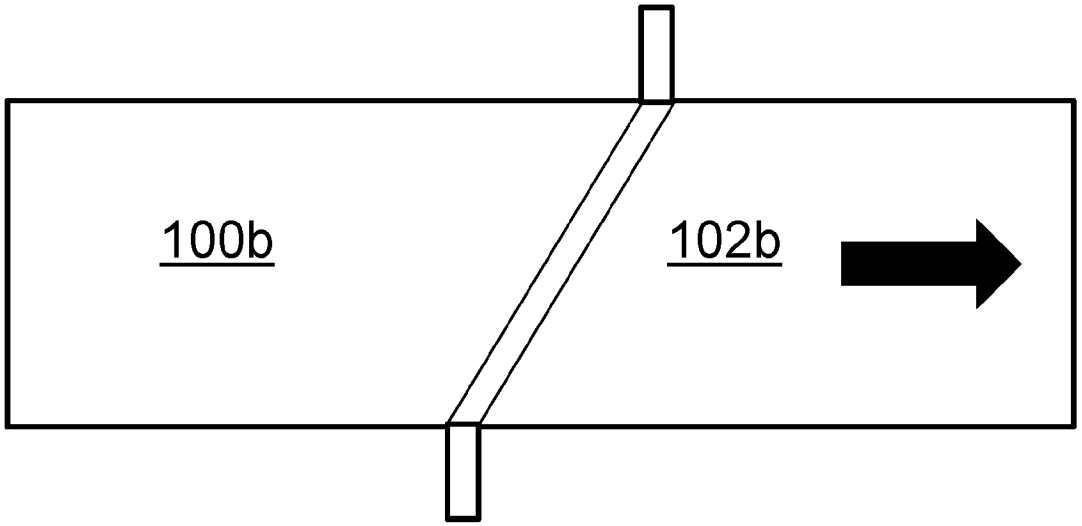
FIG. 1B PRIOR ART
FIG. 1B presents a diagram of a severed paper web having an oblique cut start and an oblique cut tail defined by a prior art turn-up cutting apparatus.
Figure 2:
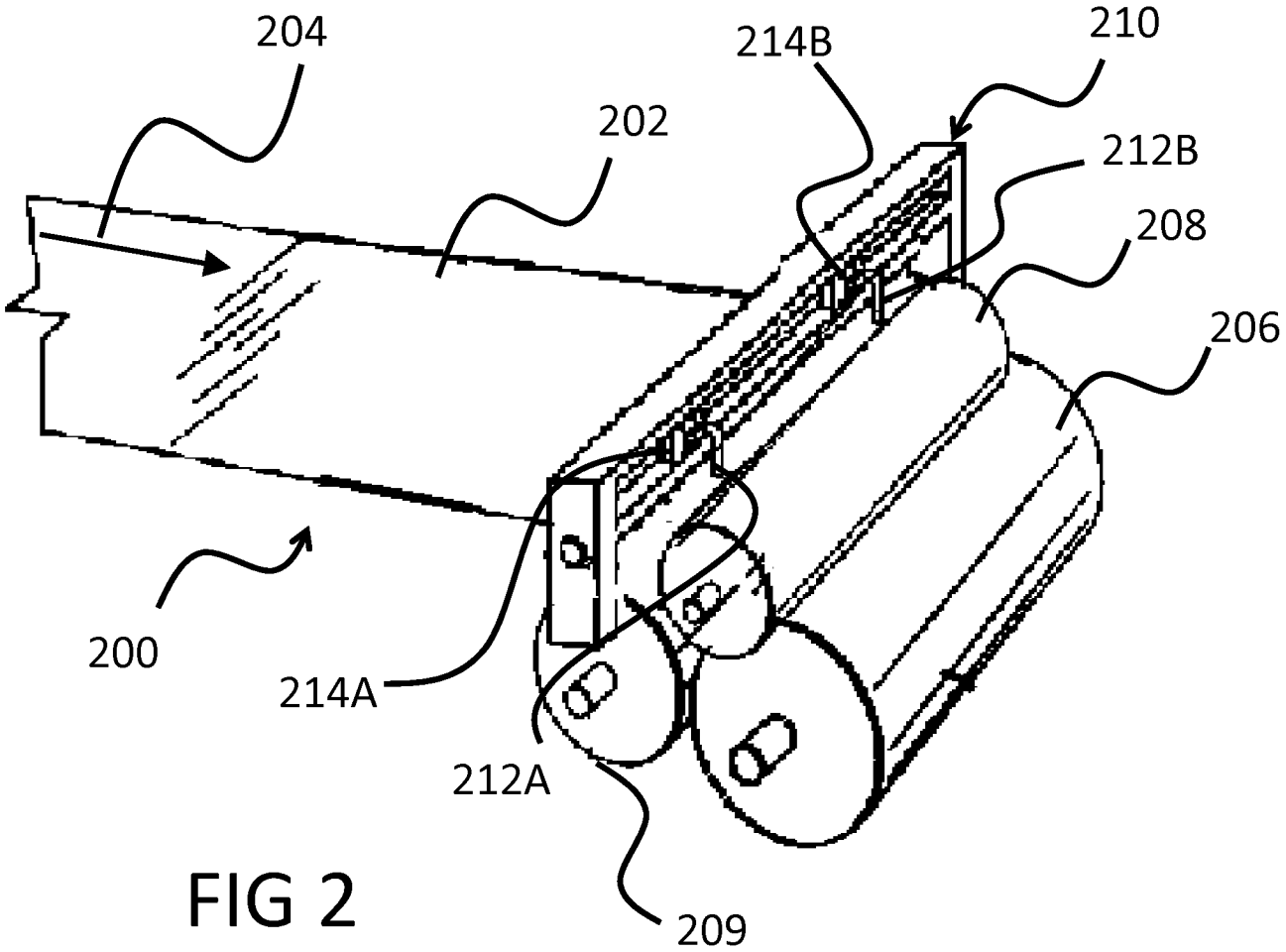
FIG. 2 presents a turn-up cutting apparatus mounted in a paper making machine for severing a paper web and defining a substantially X-shaped cut and forming a substantially V-shaped start, a substantially V-shaped tail and two wings, according to one embodiment.

Presented in FIG. 2, there is a paper making machine 200 that allows a continuous paper web 202 to travel at very high speed in a predetermined travel direction 204. In the paper making machine 200, the paper web 202 travels typically at up to around 100 km/h and is initially wound around a forming roll 206 at the same high travelling speed. When the forming roll 206 is complete, the paper making machine 200 allows the forming roll 206 to be replaced by a new spool 208.

Although the present is described according to a paper making machine that provide a paper web travelling speed of up to around 100 km/h, the present is not limited to such paper making machines. The present also applies to paper making machines that provide a slower or even faster paper web travelling speed.

Further presented in FIG. 2, there is a driving drum 209 for rotatably driving the forming roll 206 and/or rotatably driving the new spool 208, according to the traveling speed of the paper web 202. The forming roll 206 and/or the new spool are adapted to be frictionally driven by the rotational movement of the driving drum, when in contact therewith.

A skilled person will understand that the forming roll 206 and the new spool 208 may each be independently driven by a motor while in friction contact with the driving drum 209. This allows a better control of the paper winding process so as to produce a tighter winding or the paper web around forming roll 206 or new spool 208.

To replace the forming roll 206, the new spool 208 is gradually brought to a suitable rotational speed as it is lowered onto the surface of the driving drum 209. When the new spool 208 contacts the driving drum 209, the rotational speed of the two is similar and slowing down of the driving drum is thereby prevented. Also, as the new spool is gradually brought to speed there is less of a choc that is being absorbed by the new spool 208 and by the supporting means thereof. When the forming roll 206 reaches its full capacity, the paper web 202 is severed to define a web turn-up for starting a winding of the web around the new spool 208. The formed roll 206 is then gradually moved away from the driving drum and its rotational speed is gradually slowed down to a full stop thereby preventing unspooling of the roll 206. As the forming roll 206 is moved away from the driving drum, the new spool 208 is gradually brought around the driving drum 209 while remaining in contact therewith so as to be positioned in place of the forming roll 206.

For severing the continuous paper web 202, the paper making machine 200 has a web turn-up cutting apparatus 210, as further presented in FIG. 2. In this embodiment, the cutting apparatus 210 is mounted on a beam that transversally spans across the paper web 202. The cutting apparatus 210 may be positioned right above the driving drum 209 as presented in FIG. 2 or slightly upstream from the driving drum 209 to leave room for the cutting nozzles to perform a cut right on the driving drum 209.

As will be appreciated by those skilled in the art, cutting apparatus 210 can be controlled by a programmable hardware, such as a microprocessor, FPGA or DSP, and in such case, the definition of the X-shaped cut can be done through machine-executable instructions. Such instructions can be provided to the cutting apparatus using a data storage medium and communications, either using a local data connection or a network connection.

In FIG. 2, the driving drum 209 is a support for the paper web 202 as it is being severed. When the paper web 202 is being severed, the surface of the driving drum 209 counters pressure being applied by the cutting jets of the cutting apparatus 210 and thereby supports the forming web-start. Moreover as the paper web 202 is being severed in proximity with a nip formed by the new spool 208 and the drum 209, the formed web-start may be controllably guided onto the new spool 208 while maintaining a desirable tension on the paper web for a uniform wind.

According to one aspect, the cutting apparatus 210 has a first nozzle 212A and a second nozzle 212B that are each connectable to a respective water supply hose and adapted to produce a respective water cutting jet. The nozzles (212A and 212B) are each mounted on a respective nozzle carriage (214A and 214B) and are transversely movable with respect to the travel direction of the web.

A skilled person will understand that the first and second nozzles (212A and 212B) may be replaced by any other paper web cutting means or multidirectional paper cutting means such as a laser beam emitter, a knife, etc. without departing from the scope of the present web turn-up cutting apparatus 210.

Moreover, it is understandable that the cutting apparatus 210 may be mounted on any other kind of suitable support that allows a transversal displacement of the nozzles (212A and 212B) across a width of the travelling paper web 202.

Figure 3:
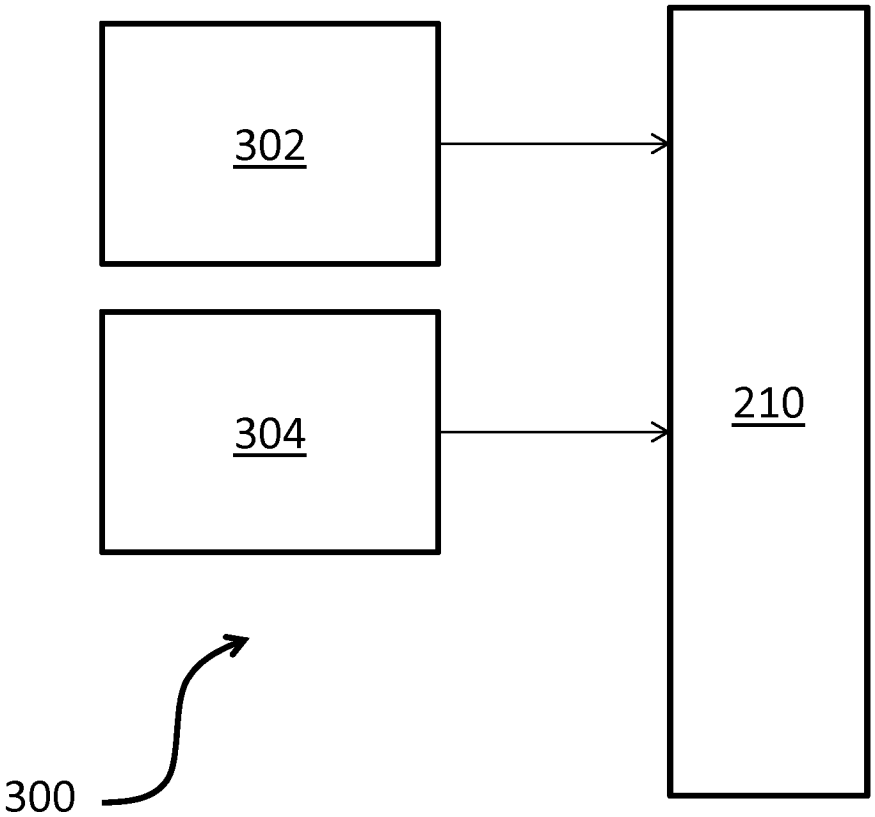
FIG. 3 presents a bloc diagram of a control system for the web turn-up cutting apparatus, according to one embodiment.

Presented in FIG. 3, is a block diagram of a control system 300 for the web turn-up cutting apparatus 210. The control system 300 has a jet controller 302 and a carriage controller 304. The jet controller is adapted to activate a water supply of each water supply hose to produce with the first and second nozzles (212A and 212B) a respective water cutting jet. The carriage controller is adapted to actuate the nozzle carriages (214A and 214B) to provide a transversal movement of the first and second nozzles (212A and 212B).

Figure 4A:
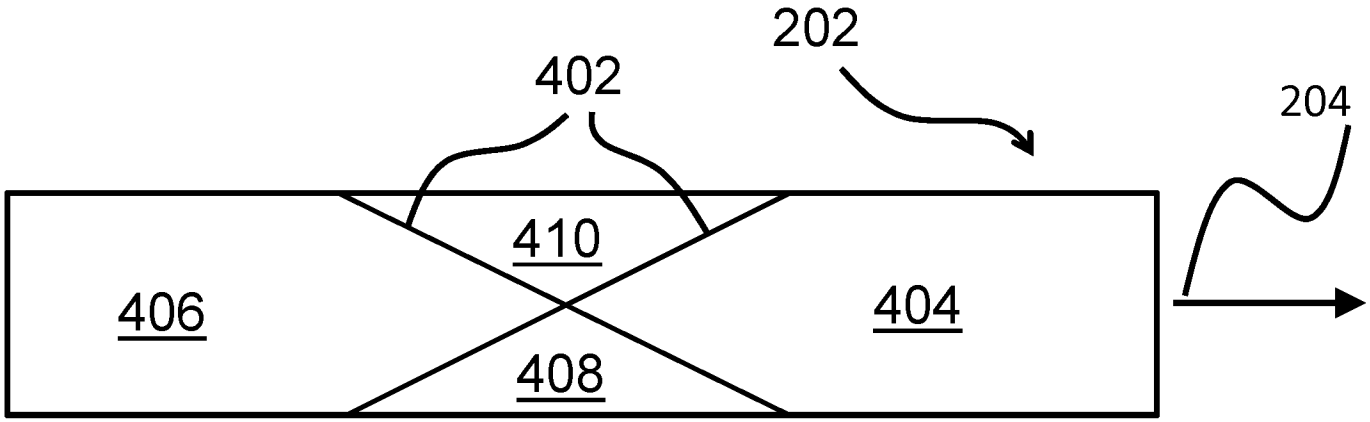
FIG. 4A presents a diagram of a severed paper web defining a substantially X-shaped cut and forming a substantially V-shaped start, a substantially V-shaped tail and two wings, according to one embodiment.

As presented in FIG. 4A, the carriage controller is adapted to actuate the nozzle carriages (214A and 214B) to provide a transversal movement of the first and second nozzles for defining a substantially X-shaped cut 402 on the traveling continuous web 202. The substantially X-shaped cut 402 defines at least a substantially V-shaped tail 404 for ending a forming roll, an opposite substantially V-shaped start 406 for starting a new spool, a detachable first wing 408 and a detachable second wing 410.

The substantially V-shaped tail 404 has a single tip and is cut to shape for remaining effectively stable as it is pulled over the drum 209 and wound around the forming roll 206. The desirable length and profile of the substantially V-shaped tail 404 may vary from one application to another and depends on the type of paper web 202 being produced as well as the sized of the formed roll 206.

The substantially V-shaped start 406 has also a single tip and is also cut to shape for remaining effectively stable as it travels over the drum 209 for engaging the new spool 208. The length and shape of the V-shaped start 406 is dependent on the traveling speed of the paper-web 202 and also on the traversing speed of the nozzles (214A and 214B).

It is important to recognize that as the V-shaped start 406 is being cut in the paper web 202, the V-shaped tail 404 is fully formed and severed from the continuous paper web 202. Consequently, the remaining portions of the continuous paper web 202 that include the two wings 408 and 410 and the V-shaped start 406 must have enough momentum to evenly and stably travel up to the nip formed by the driving drum 209 and the new spool 208. Note that in one example, as the cut 402 begins, the tips of the two wings 408 and 410 have enough momentum to carry them to the nip and when the tail 404 is fully severed the start 406 has enough moment to carry it to the nip. As the start is being severed, the tips of the two wings 408 and 410 are under tension as they are being pulled by the nip thereby allowing maintaining sheet tension until the cut 402 is completed. When the single tip of the V-shaped start 406 reaches the nip it is adapted to engage the new spool 208 and an even pull is then applied to the rest of the paper web 202 as it is being wound around the new spool 208.

Figure 4B:
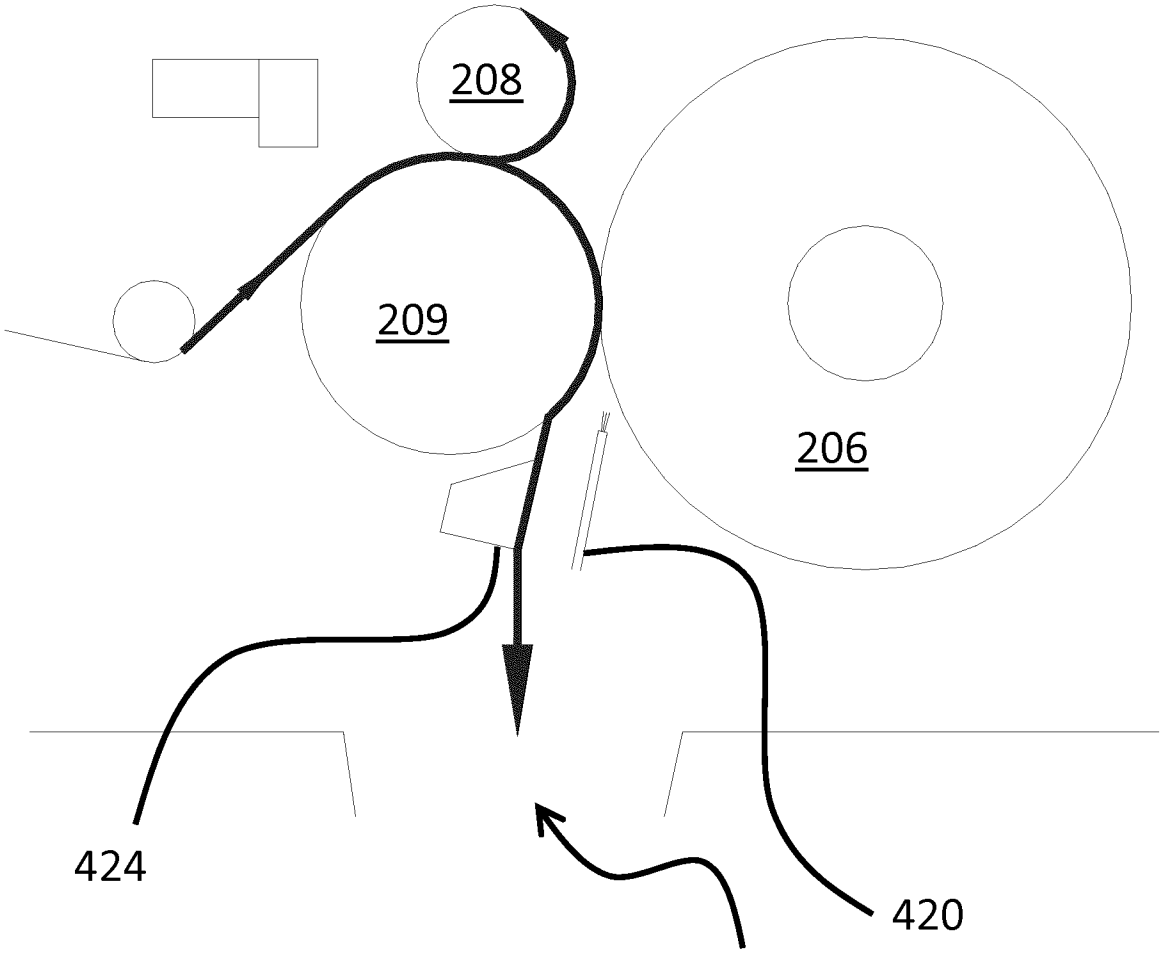
FIG. 4B presents a side view of the paper making machine with the turn-up cutting apparatus and a doctor and an air-blower for directing formed wings into a chute for re-pulping, according to one embodiment.

In one embodiment as presented in FIG. 4B, the severed two wings (408 and 410) are directed by the rotating driving drum 209 into a chute 422 for re-pulping.

In another embodiment and as further presented in FIG. 4B, an adhesive is previously applied on an underside of at least a portion of each of the two wings or directly on the driving drum 209 for allowing the two wings to adhere thereon. The adhesive may be a non-permanent adhesive such as water or a removable sealant. The wings (408 and 410) adhere to the driving drum 209 and are guided toward the chute 422. A doctor 424 is positioned for scraping the wings off from the surface of the driving drum 209 for allowing the wings to drop into the chute 422.

In yet another embodiment and as further presented in FIG. 4B, an air blower 420 is positioned for applying an air pressure on the surface of the formed roll 206 for guiding the wings (408 and 410) into the chute 422 and preventing the wings from clinging to the formed roll 206. In one instance, the air blower is positioned for applying an air pressure on the surface of the formed roll 206 below the nip area defined by the driving drum 209 and the formed roll 206.

In yet another embodiment, there is a de-ionizer for de-ionizing the paper web surface of the formed roll 206 and removing static on the surface thereof. This prevents the wings (208 and 210) from sticking onto the formed roll 206 and facilitates the directing of the wings into the chute 422.

It shall be understood that the various ways of directing the wings (408 and 410) into the chute 422 as described above may be performed separately or in combination, without departing from the scope of the present invention.

Figure 5A:
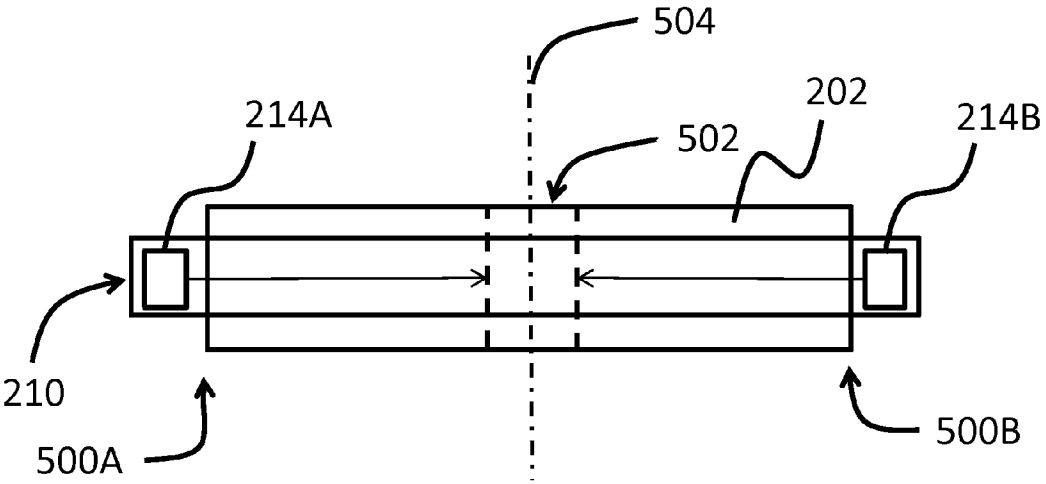
FIG. 5A presents a top view of the turn-up cutting apparatus with two nozzle carriages that are movable from a respective edge to a center portion with respect to a traveling paper web, according to one embodiment.
Figure 5B:
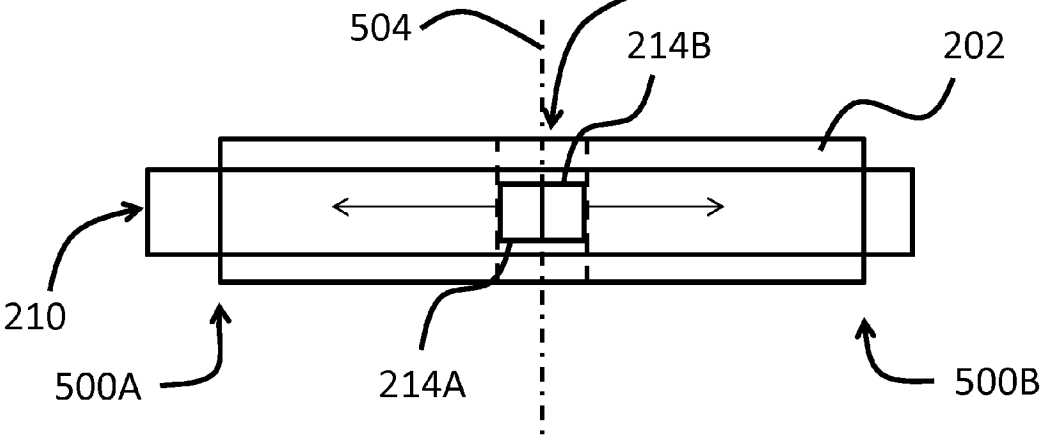
FIG. 5B presents a top view of the turn-up cutting apparatus with two nozzle carriages that are movable from a center portion to a respective edge with respect to a traveling paper web, according to one embodiment.

There are various ways of defining the substantially X-shaped cut 402 with the cutting apparatus 210. Presented in FIGS. 5A and 5B is a top view of the cutting apparatus 210 that spans across the paper web 202 from edge 500A to edge 500B. One way of defining the substantially X-shaped cut 402 is to allow the nozzle controller to actuate the nozzle carriages (214A and 214B) to provide a transversal movement of the first and second nozzles (212A and 212B) from a respective edge (500A and 500B) to a middle portion 502 of the continuous web 202 and from the middle portion 502 back to the respective edges (500A and 500B) as represented by the carriage movement arrows.

It shall be understood that the middle portion 502 may have a determined width and that the carriages (214A and 214B) may be controlled to travel up to an edge of the middle portion 502 or in proximity of the middle portion 502. Moreover the carriages may overlap at a center line 504 of the middle portion 502 or even go slightly beyond the center line 504.

Figure 6A:
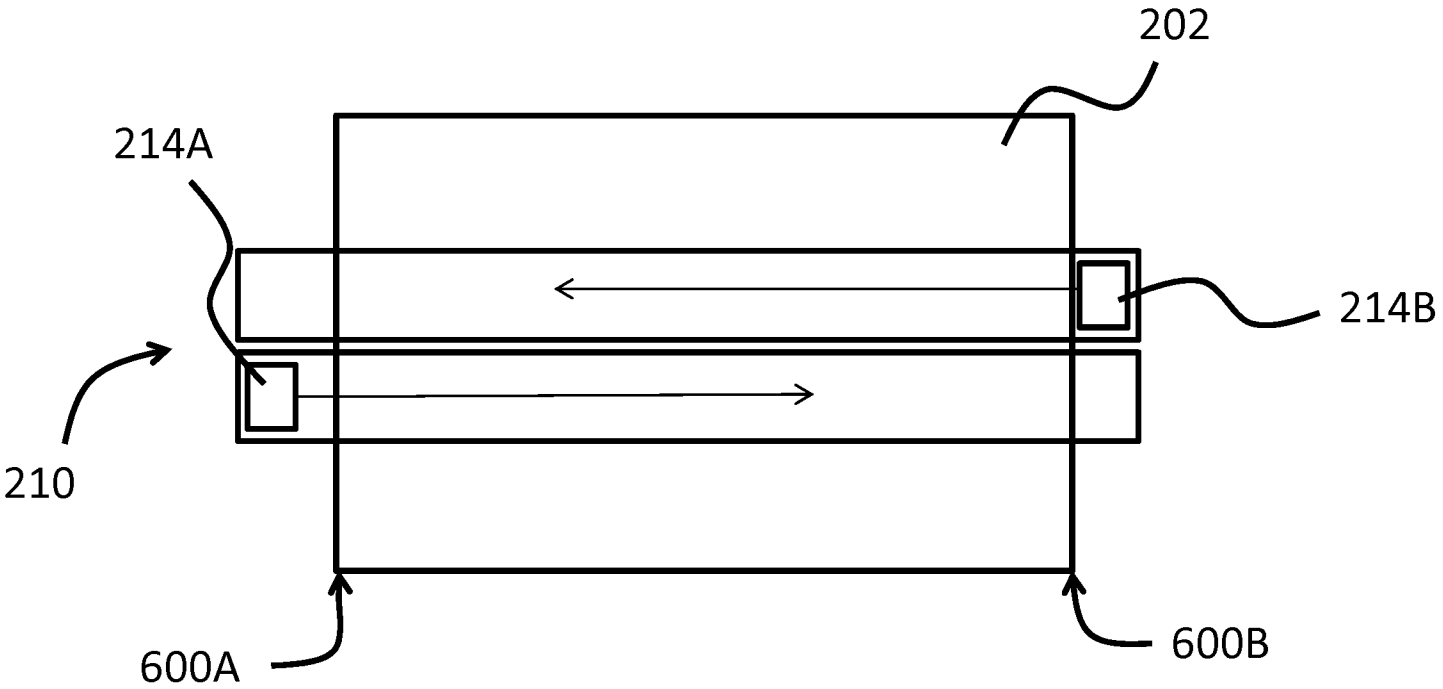
FIG. 6A presents a top view of a turn-up cutting apparatus with two nozzle carriages that are movable from a respective edge to an opposite edge with respect to a traveling paper web, according to one embodiment.

Another way of defining the substantially X-shaped cut 402 is to allow the nozzle controller to actuate the nozzle carriages (214A and 214B) for them to cross over the continuous web 202 from edge to edge. Presented in FIG. 6A is a top view of the cutting apparatus 210 that spans across the paper web 202 from edge 600A to edge 600B. The cutting apparatus 210 has two tracks, each track is adapted to guide one of the two nozzle carriages (214A and 214B).

There are various ways of positioning the two tracks. For instance, a first track may be positioned upstream and another may be positioned downstream with respect to the traveling direction of the paper web. In this case, as there is normally limited space near the driving drum 209, it may be desirable that the two tracks be positioned as close as possible to each other. Moreover, the positioning of the tracks as close as possible to each other may further be desirable for obtaining a symmetric X-shaped cut 402 and assuring an adequate level of symmetry in the substantially V-shaped start 406 for evenly re-threading the new spool 208.

Figure 6B:
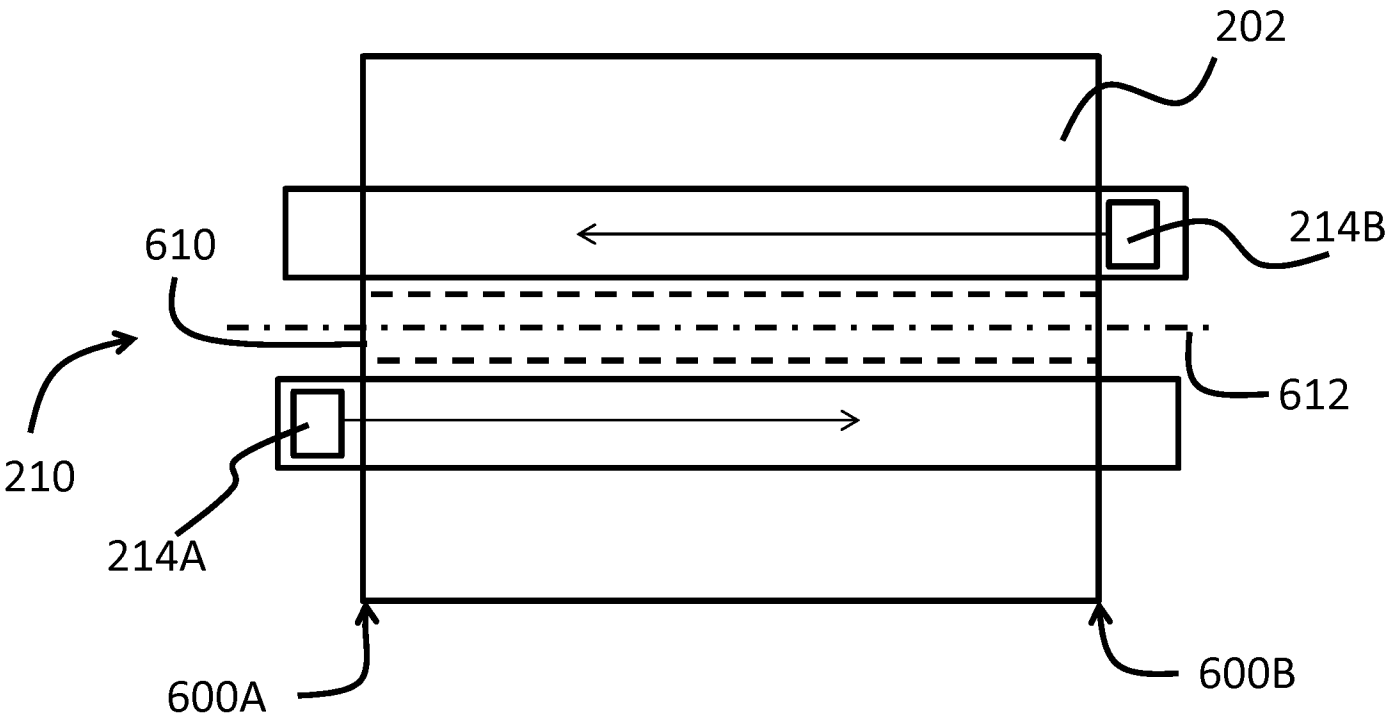
FIG. 6B presents a top view of a turn-up cutting apparatus with two nozzle carriages that are movable from a respective edge to an opposite edge with respect to a traveling paper web, each of the nozzle carriages being guided by a respective guide and each of the nozzles being adapted to direct a cutting jet toward a center portion between the guides, according to one embodiment.

For defining a symmetrical X-cut it may be desirable to orient the nozzle with a slight angle so that the nozzle may direct a water jet on a center portion 610 or right on a center line 612 between the two tracks such as presented in FIG. 6B. Alternatively, it may be desirable to control the carriage positioned on the upstream track to be activated with a slight delay, for crossing over to the opposite edge, with respect to the activation of the carriage positioned on the downstream track and thereby defining a symmetrical X-cut.

Figure 6C:
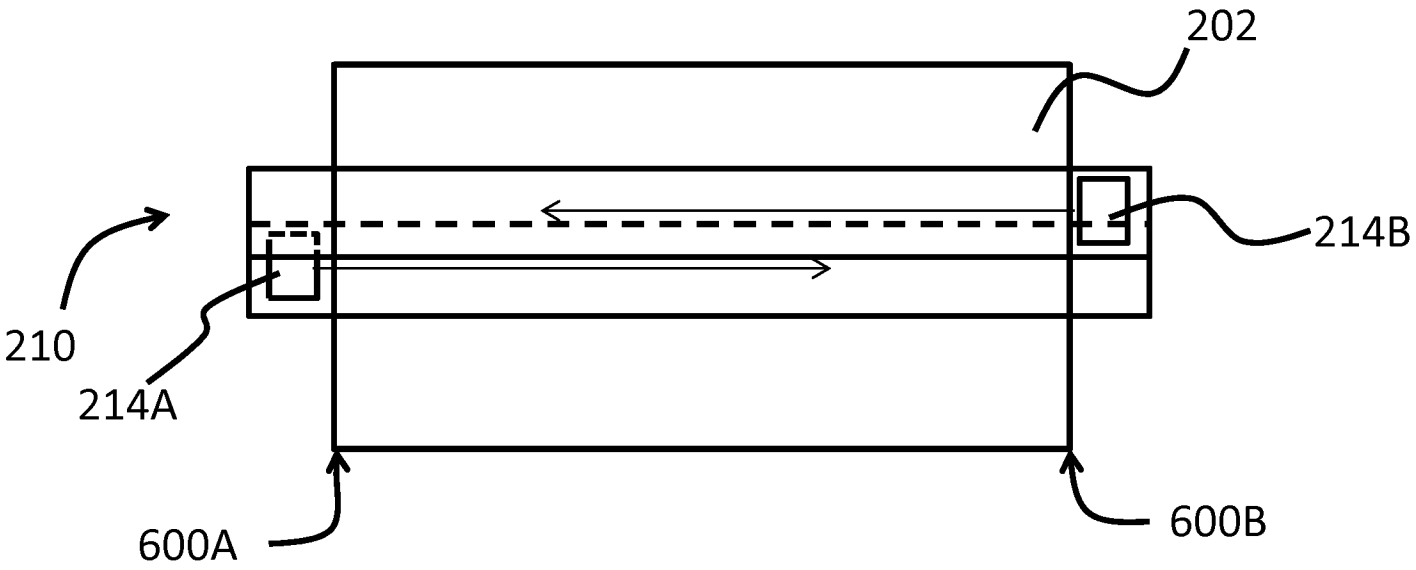
FIG. 6C presents a top view of a turn-up cutting apparatus with two nozzle carriages that are movable from a respective edge to an opposite edge with respect to a traveling paper web, each of the nozzle carriages being guided by a respective guide that are positioned one above another, according to one embodiment.

In another instance, the first tract may be positioned above the other track, as presented in FIG. 6C. A first tract is decentered with respect to the other track for allowing water jet produced by the nozzle of the first tract to hit the traveling paper web 202.

A skilled person will understand that any combination of the embodiments described in the FIGS. 6A, 6B and 6C is possible without departing from the scope of the claimed apparatus.

Figure 7A:
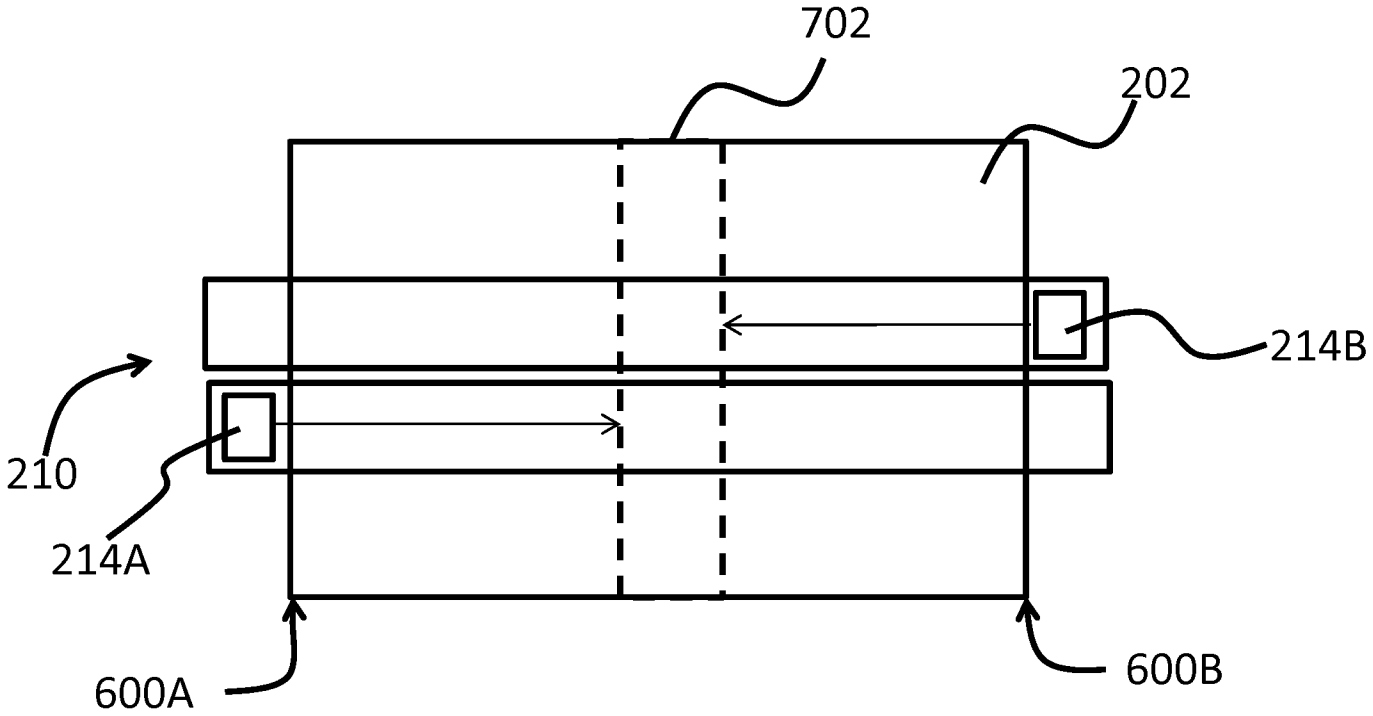
FIG. 7A presents a top view of a turn-up cutting apparatus with two nozzle carriages that are movable from a respective edge to a middle portion, each of the nozzle carriages being guided by a respective guide, according to one embodiment.
Figure 7B:
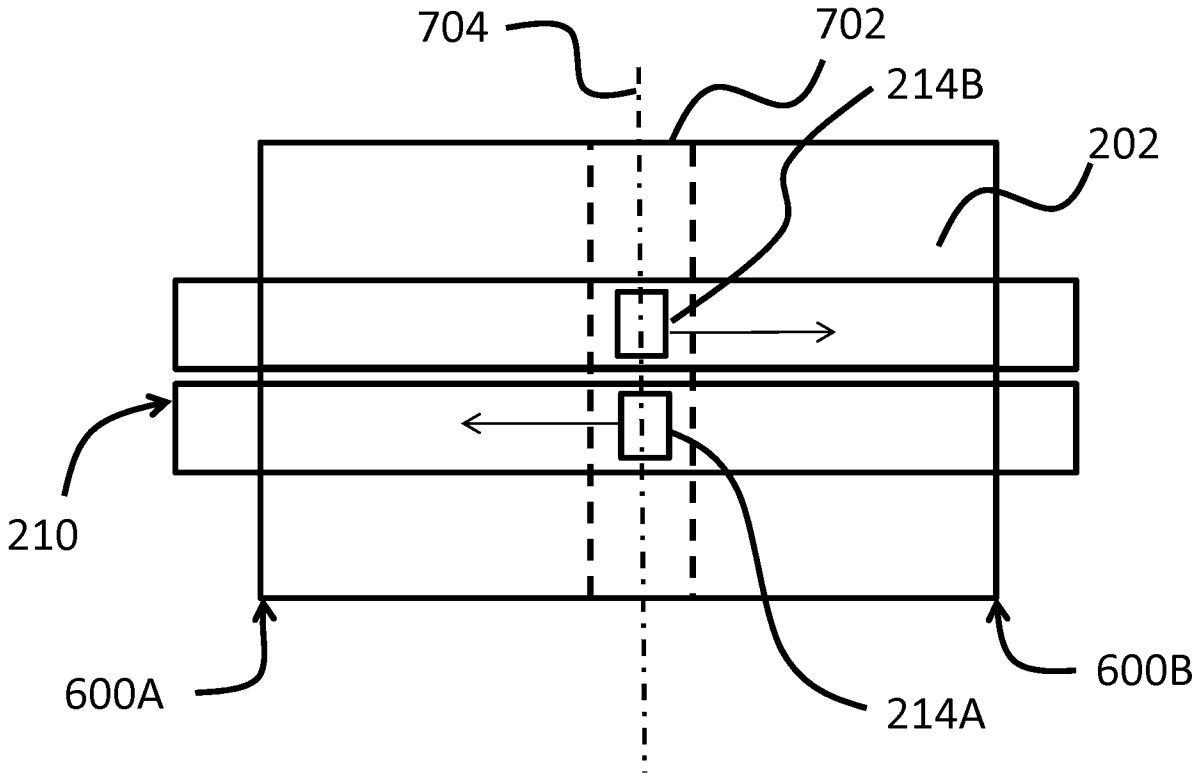
FIG. 7B presents a top view of the turn-up cutting apparatus of FIG. 7A with the two nozzle carriages that are movable from a center line of the middle portion to a respective edge, according to one embodiment.
Figure 7C:
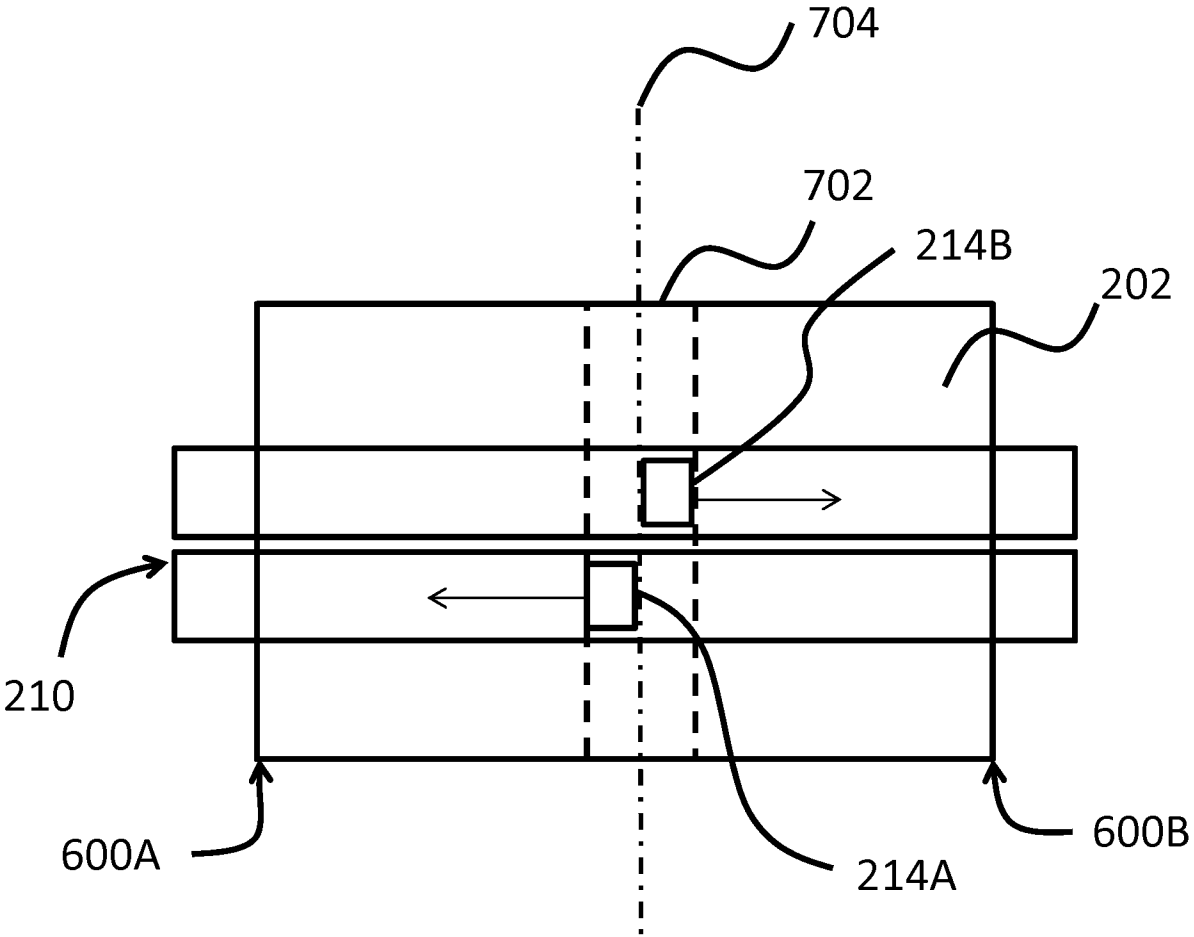
FIG. 7C presents a top view of the turn-up cutting apparatus of FIG. 7A with the two nozzle carriages that are movable from the middle portion to a respective edge, according to one embodiment.
Figure 7D:
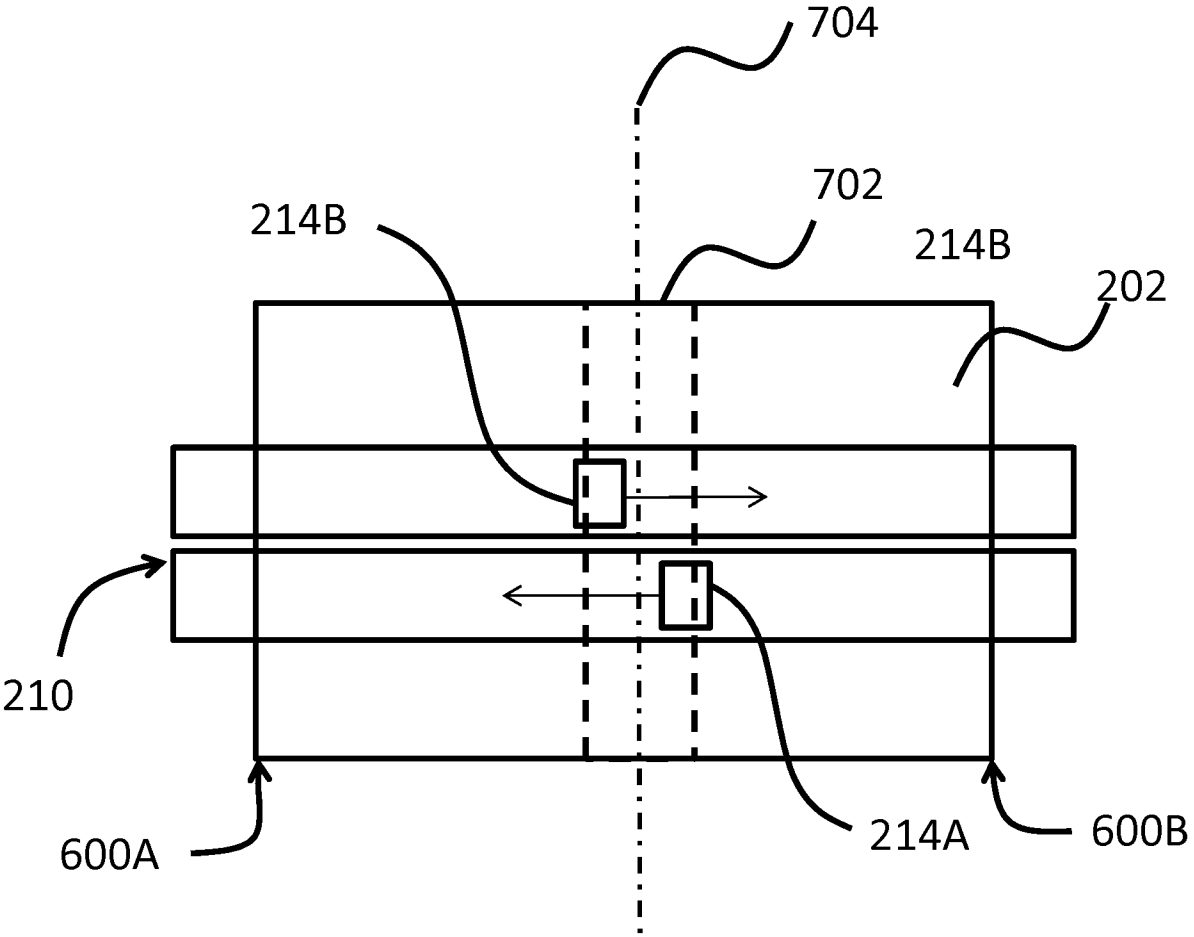
FIG. 7D presents a top view of the turn-up cutting apparatus of FIG. 7A with the two nozzle carriages that are movable from slightly beyond the center line of the middle portion to a respective edge, according to one embodiment.

It is to be understood that as the cutting apparatus of FIGS. 5A and 5B, the cutting apparatus of FIGS. 6A, 6B and 6C may allow the nozzle controller to actuate the nozzle carriages (214A and 214B) to travel only up to a middle portion 702 and then back to the respective edges as presented in FIGS. 7A, 7B, 7C, 7D. In FIG. 7B, the nozzle controller actuates the nozzle carriages to travel up to a center line 704 of the middle portion 702 by longitudinally aligning the nozzle carriages with respect to the paper web 202 travel direction. In FIG. 7C, the nozzle controller actuates the nozzle carriages to travel to the middle portion 702 without longitudinal alignment of the nozzle carriages. In FIG. 7D, the nozzle controller actuates the nozzle carriages to travel up to slightly beyond the center line 704.

In the above described web turn-up cutting apparatus 210, it is possible for the carriage controller 304 to actuate the nozzle carriages (214A and 214B) and allow the nozzles (212A and 212B) to define together the substantially X-shaped cut on the traveling continuous web 202 in less than 3 seconds. It is however understandable that the substantially X-shaped cut may take longer than 3 seconds to be defined, depending on the width of the paper web, the speed of the nozzles or the speed of the paper web.

It shall further be understood by the various embodiments of the web turn-up cutting apparatus 210 described herein that the carriage controller is adapted to actuate each of the nozzle carriages (214A and 214B) from an initial position to a final position for defining with the nozzles the substantially X-shaped cut. Once in the final position the nozzle carriages are readily positioned for performing a subsequent cut. The nozzle carriages do not require being controlled for returning to an initial position for performing a subsequent cut. As the nozzle carriages do not require being re-positioned for performing a subsequent cut, the nozzle carriage traveling distance on the track is limited and this may extend the operational life of the track and nozzle carriage. Moreover, this prevents water dripping from the nozzles to unnecessarily wet a span of the traveling web as it normally may when being re-positioned for a subsequent cut.

The shape of the substantially X-shaped cut 402 differs depending on a trajectory and speed of each carriage. The trajectory and speed of each carriage may be controlled for defining a desired start and tail profile according to a property of the paper web. Presented in FIGS. 8A, 8B, 8C, 8D and 8E are examples of the various possible cut shapes that the apparatus may be adapted to define.

Figure 8A:
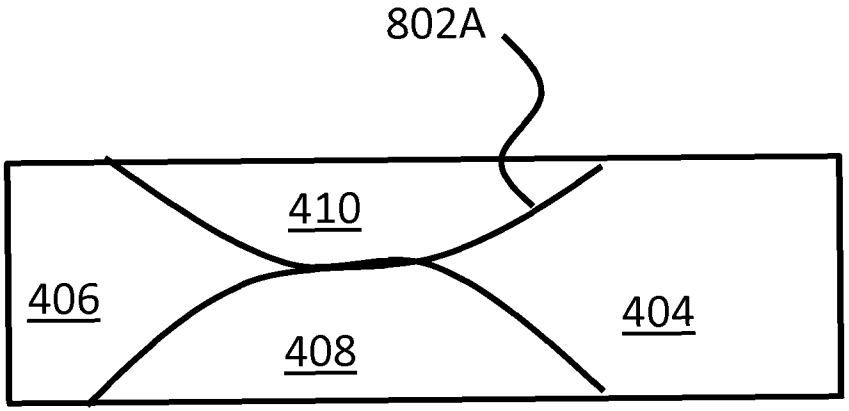
FIG. 8A presents a diagram of a severed paper web defining a substantially X-shaped cut and forming a substantially V-shaped start, a substantially V-shaped tail and two wings, according to one embodiment.

According to one embodiment and as presented in FIG. 8A, the web turn-up cutting apparatus is adapted to form a substantially X-shaped cut 802A for only defining a substantially V-shaped tail 404, an opposite substantially V-shaped start 406, a detachable first wing 408 and a detachable second wing 410. This cut may be defined by various types of cutting apparatus 210 such as the one presented in FIGS. 5A and 5B. For defining such a cut with the cutting apparatus 210 of FIGS. 5A and 5B, the carriage controller is adapted to actuate the nozzle carriages (214A and 214B) to travel from the respective edge to the middle portion 502 and in proximity to the center line 504 and then back to the respective edge. In this embodiment, each of the nozzles (212A and 212B) are mounted on a corresponding one of the carriages (214A and 214B) so as to direct a water jet right on the center line 504 when the carriages reach the furthest traveling limit within the middle portion 502. The nozzle controller is adapted to actuate the nozzle carriages to provide a transversal movement of a first nozzle and of a second nozzle for creating respectively a first cut line and a second cut line that join in the middle portion of the continuous web. There is a single center cut line being defined by the joining of the first and the second cut lines. This cut may further be defined by the cutting apparatus 210 of FIGS. 7A and 7B.

Figure 8B:
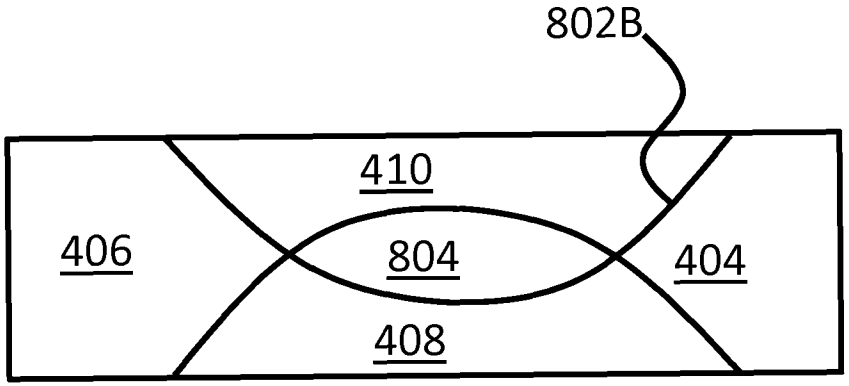
FIG. 8B presents a diagram of a severed paper web defining a substantially X-shaped cut and forming a substantially V-shaped start, a substantially V-shaped tail two wings and a detachable middle strip, according to one embodiment.

According to another embodiment and as presented in FIG. 8B, the web turn-up cutting apparatus is adapted to form a substantially X-shaped cut 802B for additionally defining a detachable middle strip 804. This cut may be defined by various types of cutting apparatus 210 such as the one presented in FIGS. 7A and 7D There is a second nozzle that is positioned upstream from a first nozzle and the nozzle controller is adapted to actuate the nozzle carriages to provide a transversal movement of the first and second nozzles for defining respectively a first cut line and a second cut line that cross in the middle portion of the continuous web. The first cut line and the second cut line cross at a first middle portion point and at a second middle portion point, wherein the first middle portion point is upstream from the second middle portion point. The detachable middle strip being defined by the first cut line and the second cut line between the first and second middle portion points.

Figures 8C, 8D, 8E:
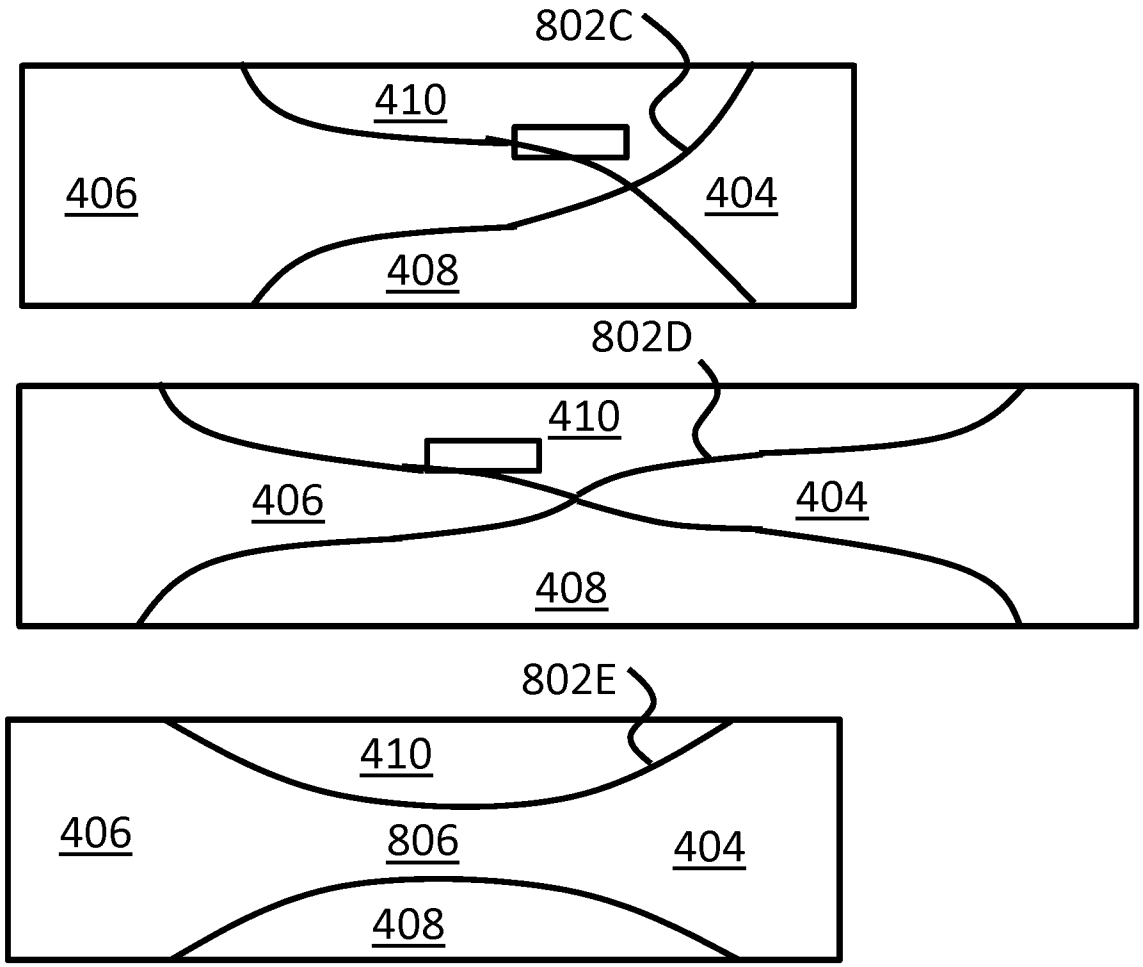
FIG. 8C presents a diagram of a severed paper web defining a substantially X-shaped cut and forming a substantially elongated V-shaped start, a substantially V-shaped tail and two wings, according to one embodiment.
FIG. 8D presents a diagram of a severed paper web defining a substantially X-shaped cut and forming a substantially elongated V-shaped start, a substantially elongated V-shaped tail and two wings, according to one embodiment.
FIG. 8E presents a diagram of a severed paper web defining a substantially X-shaped cut and forming a substantially V-shaped start, a substantially V-shaped tail and two wings and a middle strip, according to one embodiment.

According to another embodiment and as presented in FIG. 8C, the web turn-up cutting apparatus is adapted to form a substantially X-shaped cut 802C for defining an elongated start 406. The controller is adapted to reduce the speed of the carriages from a predetermined high speed to a predetermined low speed when the carriages travel from a middle portion of the web toward an edge. The controller is further adapted to increase the speed of the carriages from the predetermined low speed to a predetermined high speed when the carriages approach an edge of the web. When producing a paper web of a heavier weight, such an elongated start may be desirable for facilitating a tight winding of the start around the new spool.

In an alternate embodiment and as presented in FIG. 8D, the web turn-up cutting apparatus is adapted to form a substantially X-shaped cut 802D for defining an elongated tail 404 and an elongated start 406. The controller is adapted to reduce the speed of the carriages from a predetermined high speed to a predetermined low speed when the carriages reach a middle portion of the web. The controller is further adapted to increase the speed of the carriages from the predetermined low speed to a predetermined high speed when the carriages approach an edge of the web. When producing a paper web of a heavier weight, such an elongated tail and start may be desirable for facilitating a tight winding of the tail around the formed roll and a tight winding of the start around the new spool.

A skilled person will understand that the carriages may be controlled at a number of various predetermined speeds for defining the substantially X-shaped cut without departing from the scope of the present invention.

According to another embodiment and as presented in FIG. 8E, the web turn-up cutting apparatus 210 is further adapted to define a middle strip 806 connecting the substantially V-shaped tail 404 and the substantially V-shaped start 406. This cut may be defined by various types of cutting apparatus 210 such as the ones presented in FIGS. 5A and 5B, and FIGS. 7A and 7C. The nozzle controller is adapted to actuate the nozzle carriages to provide a transversal movement of a first nozzle and of a second nozzle for creating respectively a first cut line and a second cut line that remain separate in the middle portion of the continuous web, thereby forming the middle strip 406.

Figure 9:
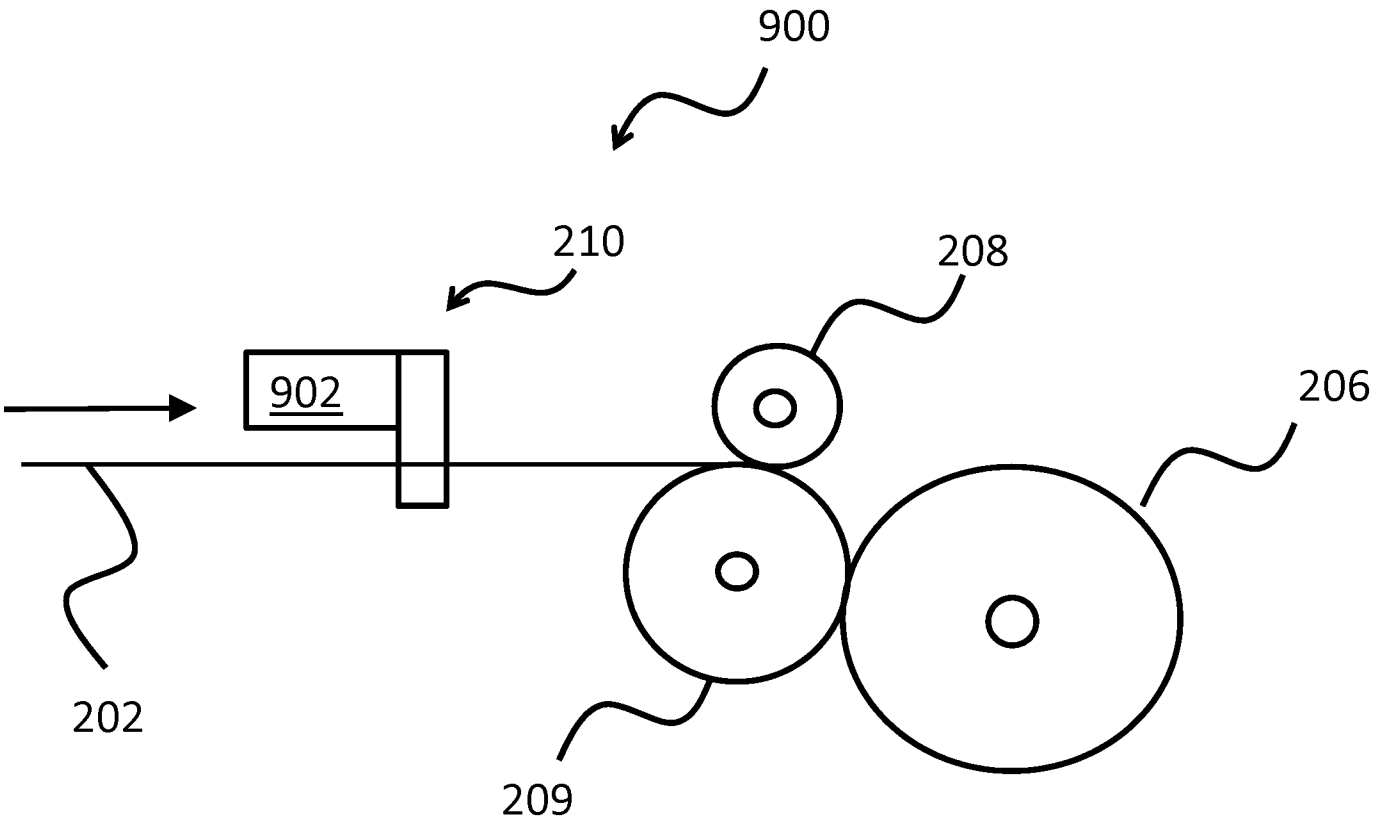
FIG. 9 presents a diagram of a paper making machine having a web turn-up cutting apparatus and an adhesive applicator for applying an adhesive on at least a portion of the middle strip, according to one embodiment.
Figure 10:
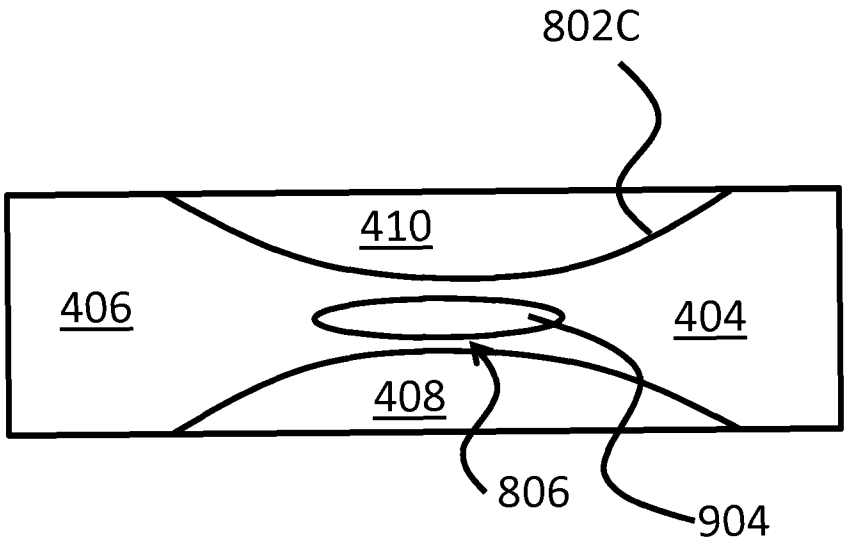
FIG. 10 presents an diagram of the severed paper web of FIG. 8E with adhesive applied on at least a portion of the middle strip, according to one embodiment.

Presented in FIG. 9 according to one embodiment, there is a paper making machine 900 with the web turn-up cutting apparatus 210 that is adapted to define the middle strip 806 as concurrently presented in FIG. 10. This web turn-up cutting apparatus 210 comprises an adhesive applicator 902 that is adapted to apply an adhesive 904 on at least a portion of the middle strip 806 and allow the at least portion of the middle strip 806 to adhere on a winding surface of the new spool 208. This causes the substantially V-shaped tail 404 to sever from the continuous paper web 202 for ending the forming roll 206 and further causes the substantially V-shaped start 406 to wind around the new spool 208.

Figure 11:
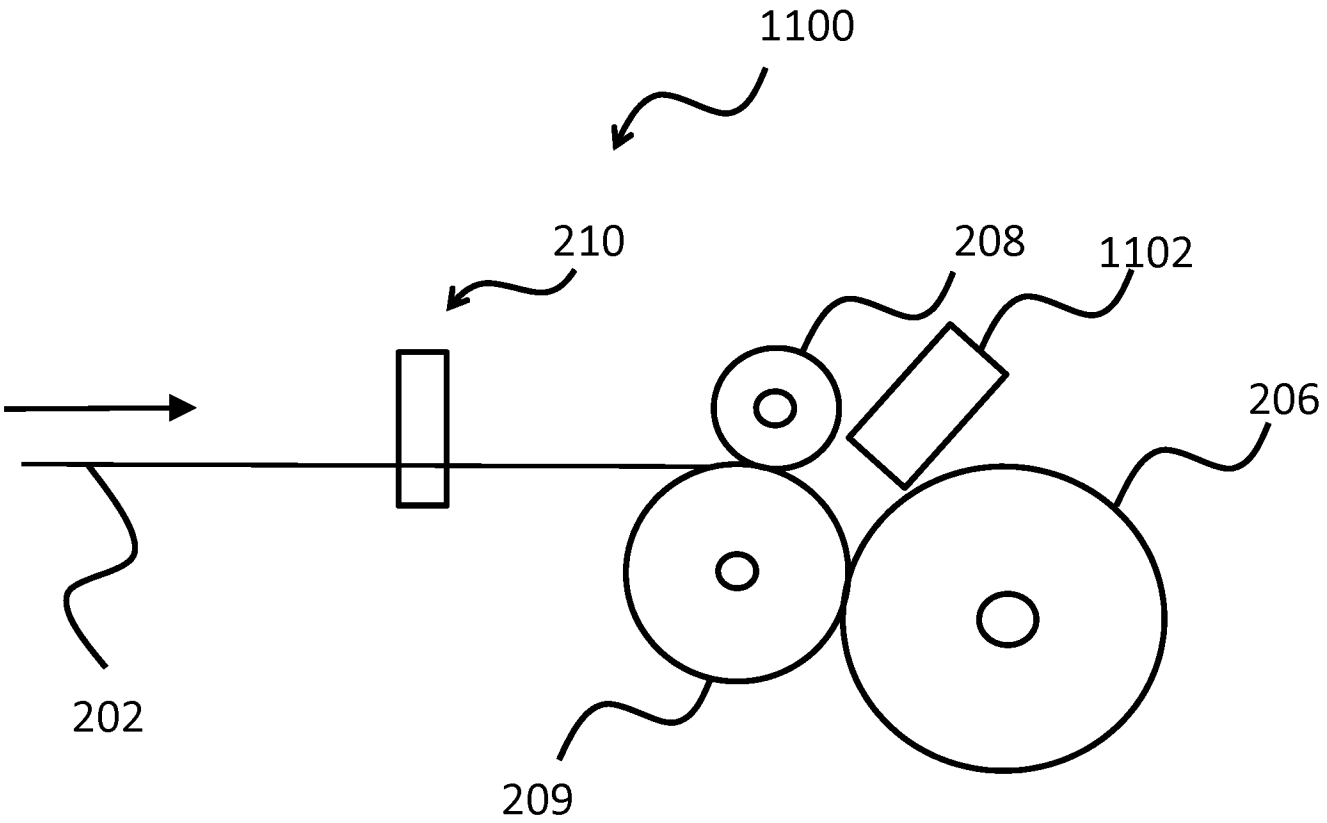
FIG. 11 presents a diagram of a paper making machine having a web turn-up cutting apparatus and an adhesive applicator for applying an adhesive on at least a portion of the substantially V-shaped tail or substantially V-shaped start, according to one embodiment.
Figure 12A:
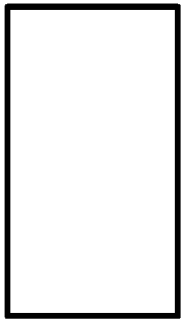
FIG. 12 presents a diagram of the severed paper web of FIG. 8A with adhesive applied on at least a portion of the substantially V-shaped tail, according to one embodiment.
Figure 12C:
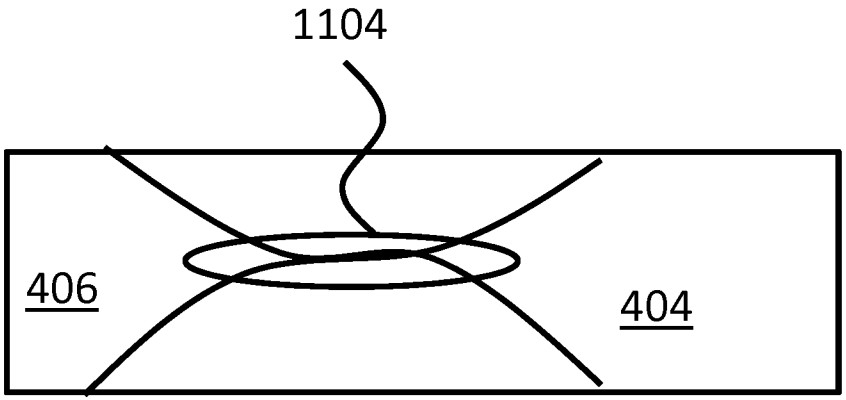
Figure 12C:
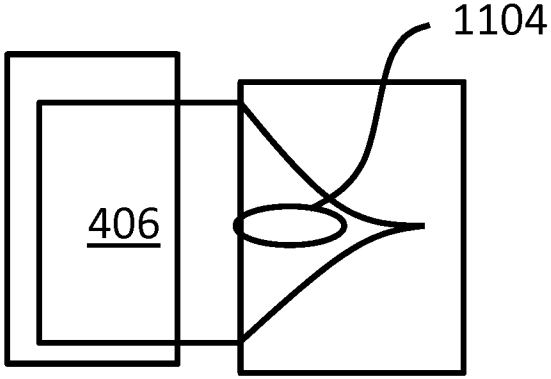
Figure 12B:
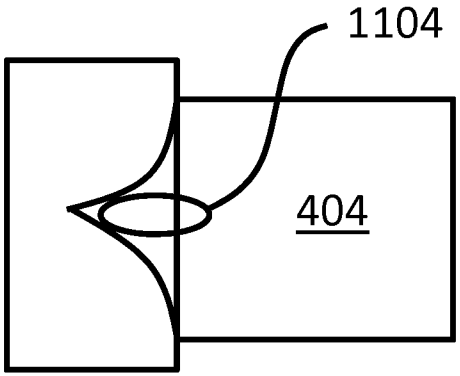

Presented in FIG. 11 according to one embodiment, there is a paper making machine 1100 that comprises an adhesive applicator 1102 that is positioned in proximity of a travel path of the paper web 210 between the new spool 208 and the forming roll 206. As presented in FIG. 12, the adhesive applicator 1102 is adapted to apply an adhesive 1104 on at least a portion of the substantially V-shaped tail 404. This allows the V-shaped tail 404 to adhere on a winding surface of the forming roll 206 as the substantially V-shaped tail 404 is wound thereon.

Figure 13:
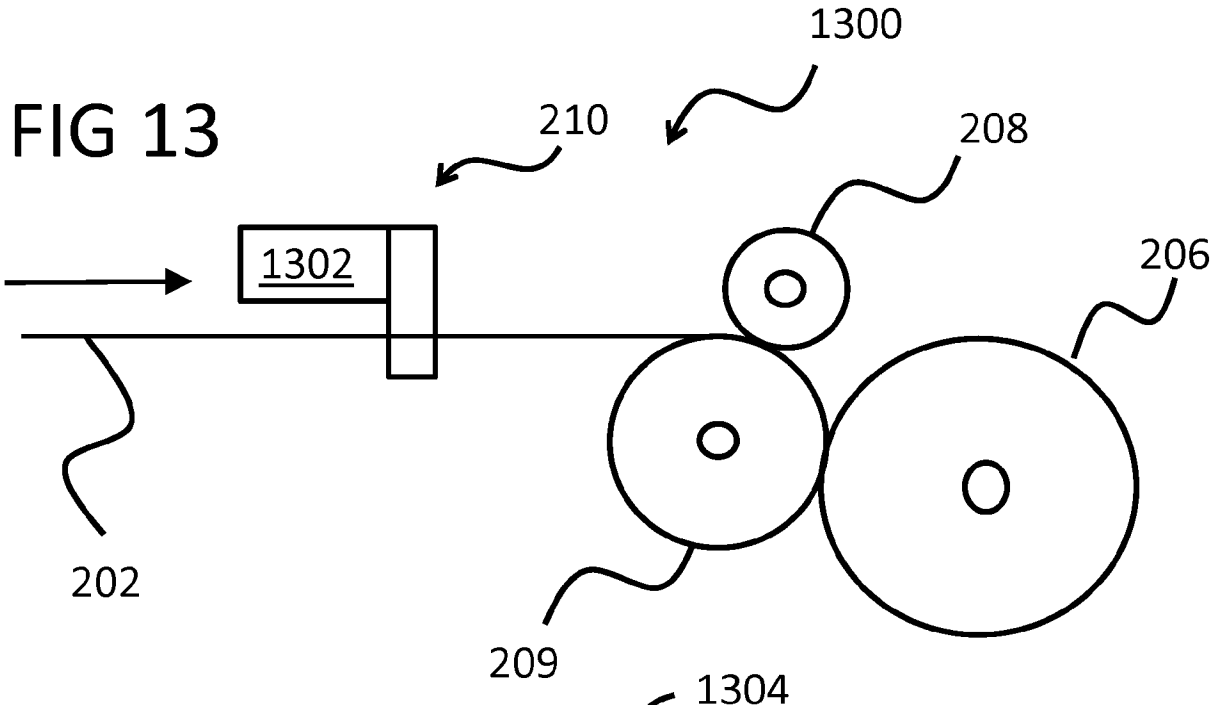
FIG. 13 presents a diagram of a paper making machine having a web turn-up cutting apparatus and an adhesive applicator for applying an adhesive on at least a portion of the substantially V-shaped start, according to one embodiment.

Presented in FIG. 13 according to one embodiment, there is a paper making machine 1300 with the web turn-up cutting apparatus 210 comprising an adhesive applicator 1302.

Figure 14:
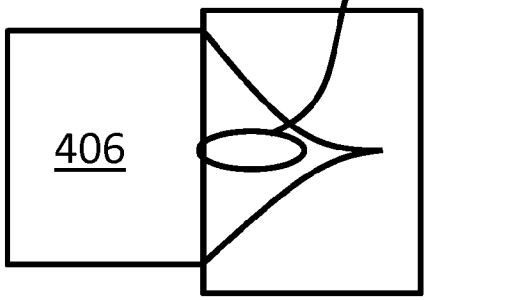
FIG. 14A presents a diagram of the severed paper web of FIG. 8A with adhesive applied on at least a portion of the substantially V-shaped tail and on at least a portion of the substantially V-shaped start, according to one embodiment.
FIG. 14B presents a diagram of the severed paper web of FIG. 8A with adhesive applied on at least a portion of the substantially V-shaped start, according to one embodiment.

As presented in FIG. 14A, the adhesive applicator 1302 is adapted to apply an adhesive 1304 on at least a portion of the substantially V-shaped tail 404 and on at least a portion of the substantially V-shaped start 406. This allows the V-shaped tail 404 to adhere on a winding surface of the forming roll 206 as the substantially V-shaped tail 404 is wound thereon and allows the V-shaped start 406 to adhere on a winding surface of the new spool as the substantially V-shaped start 406 is wound thereon. In one example, the adhesive applicator 1302 is activated to spay adhesive right at the end of the V-shaped tail 404 and to overspray adhesive onto a very tip portion of the V-shaped start 406.

In another embodiment, the adhesive applicator 1302 of FIG. 13 is adapted to apply an adhesive 1304 on at least a portion of the substantially V-shaped start 406, as presented in FIG. 14B.

Figure 15:
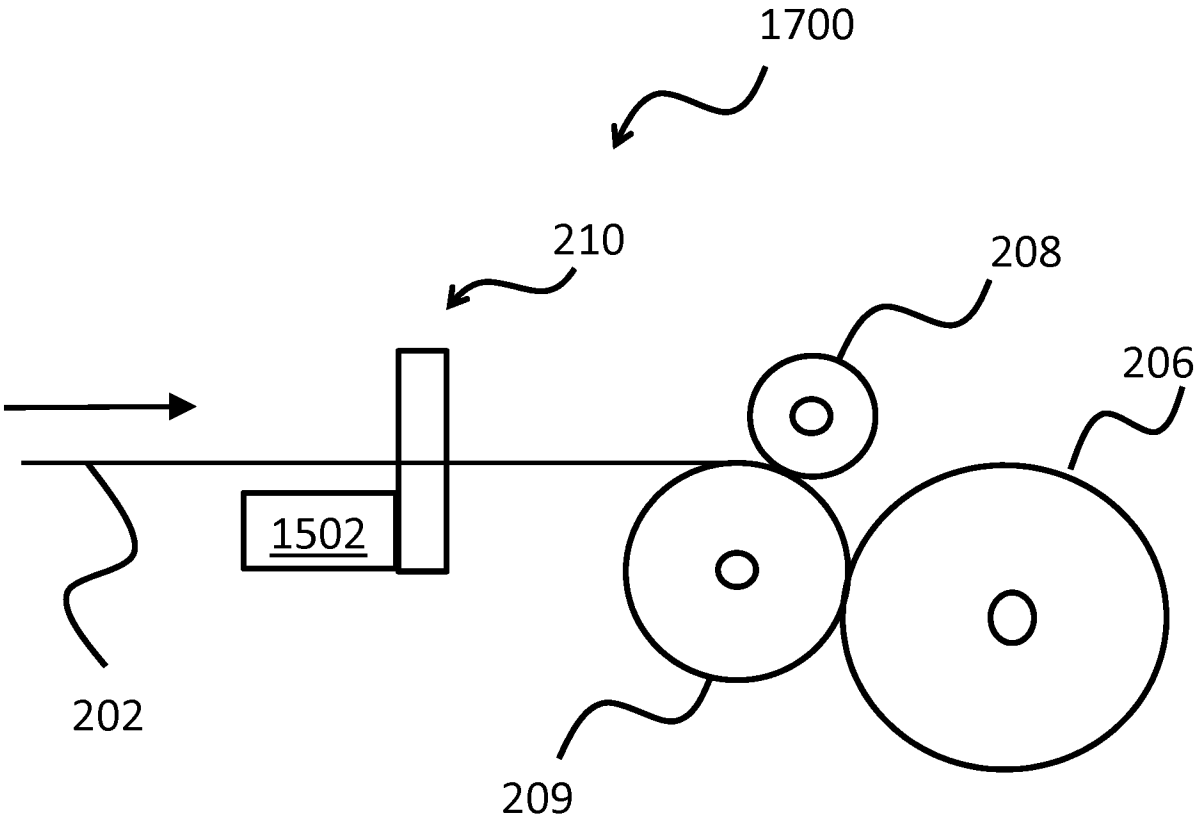
FIG. 15 presents a diagram of a paper making machine having a web turn-up cutting apparatus and an adhesive applicator for applying an adhesive on at least a portion of the two wings, according to one embodiment.
Figure 16A:
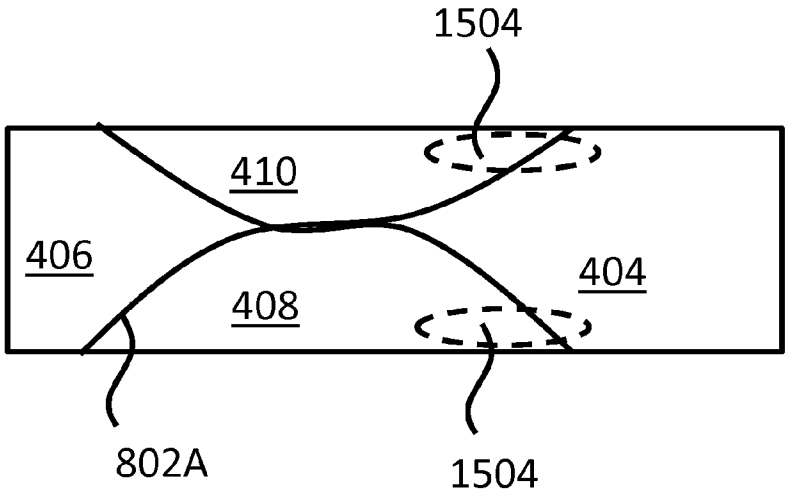
FIG. 16A, presents a diagram of the severed paper of FIG. 8A with adhesive applied on an underside of at least a portion of the two wings, according to one embodiment.
Figure 16B:
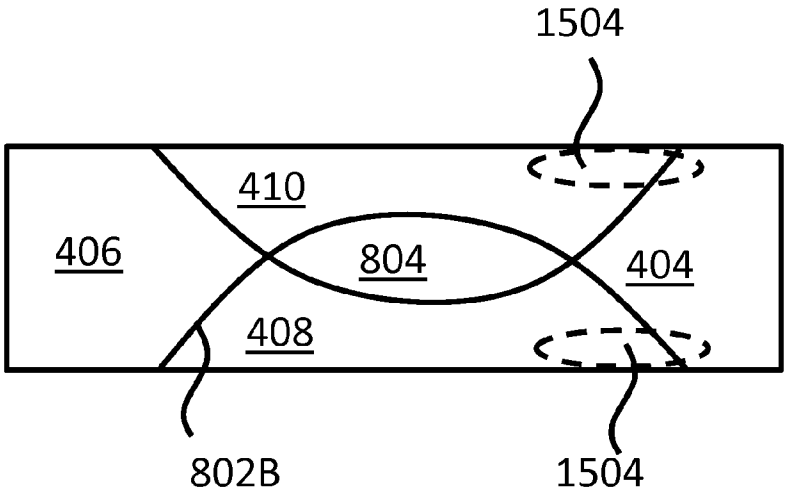
FIG. 16B, presents a diagram of the severed paper of FIG. 8B with adhesive applied on an underside of at least a portion of the two wings, according to one embodiment.

Presented in FIG. 15 according to one embodiment, there is a paper making machine 1500 with the web turn-up cutting apparatus 210 comprising a wing adhesive applicator 1502. The wing adhesive applicator 1502 is adapted to apply an adhesive 1504 on at least a portion of the first and the second detachable wings (408 and 410) and allow the first and second detachable wings to engageably adhere to the driving drum 209 of the papermaking machine and detach from the continuous paper web 202, as concurrently presented in FIGS. 16A and 16B. It is understandable that the adhesive requires being applied on a side of the paper web 220 that can contact the driving drum 209. In this embodiment, as the driving drum is positioned at an underside of the travelling paper web 202, the adhesive applicator 1502 is also positioned in proximity with the travelling paper web 202 on an underside thereof.

Figure 16C:
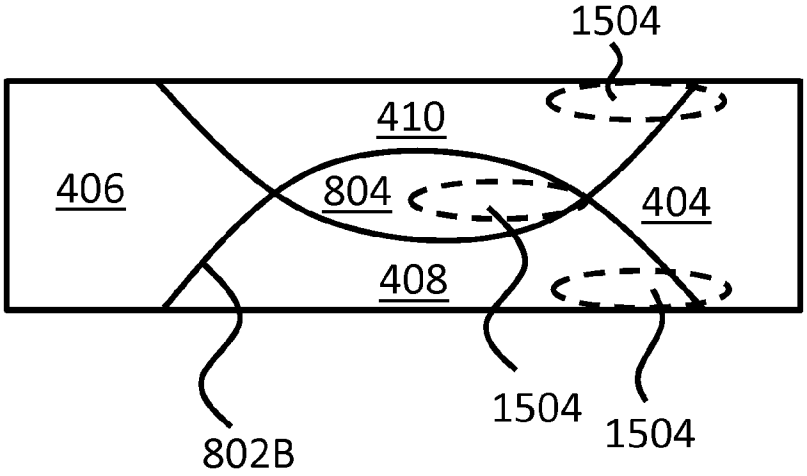
FIG. 16C, presents a diagram of the severed paper of FIG. 8B with adhesive applied on an underside of at least a portion of the two wings and the detachable middle strip, according to one embodiment.
Figure 16D:
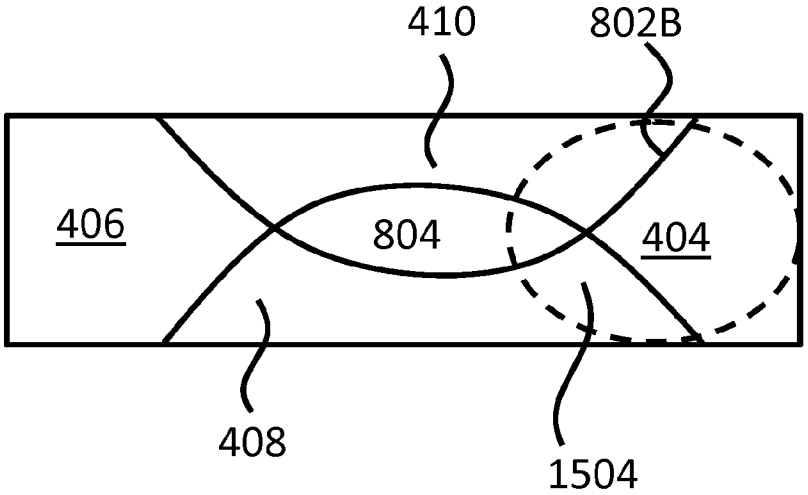
FIG. 16D, presents a diagram of the severed paper of FIG. 8B with adhesive applied on at least an underside portion of the two wings and the detachable middle strip, according to one embodiment.

According to an alternate embodiment, the wing adhesive applicator 1502 is further adapted to apply the adhesive 1504 on at least a portion of the detachable middle strip 804 and allow the detachable middle strip 804 to engageably adhere to the driving drum 209, as concurrently presented in FIG. 16C. In FIG. 16C, it is noticeable that the adhesive applicator 1502 is adapted to apply the adhesive 1504 separately on at least a portion of each of the first and second detachable wings (408 and 410) and middle strip 804. However, it is understandable that the adhesive applicator 1504 may further apply the adhesive 1504 in any other suitable way such as by an adhesive 1504 that is applied right across at least a portion of each of the first and second detachable wings (408 and 410) and middle strip 804 as presented in FIG. 16D.

In anyone of the embodiments illustrated in FIGS. 16A to 16D the adhesive applicator 1502 of FIG. 15 may be activated to apply adhesive on the very tip of the wings (408 and 410) or middle strip 804. In this case, some adhesive may be applied onto the tail 404 without departing from the scope of the present invention.

Figure 17:
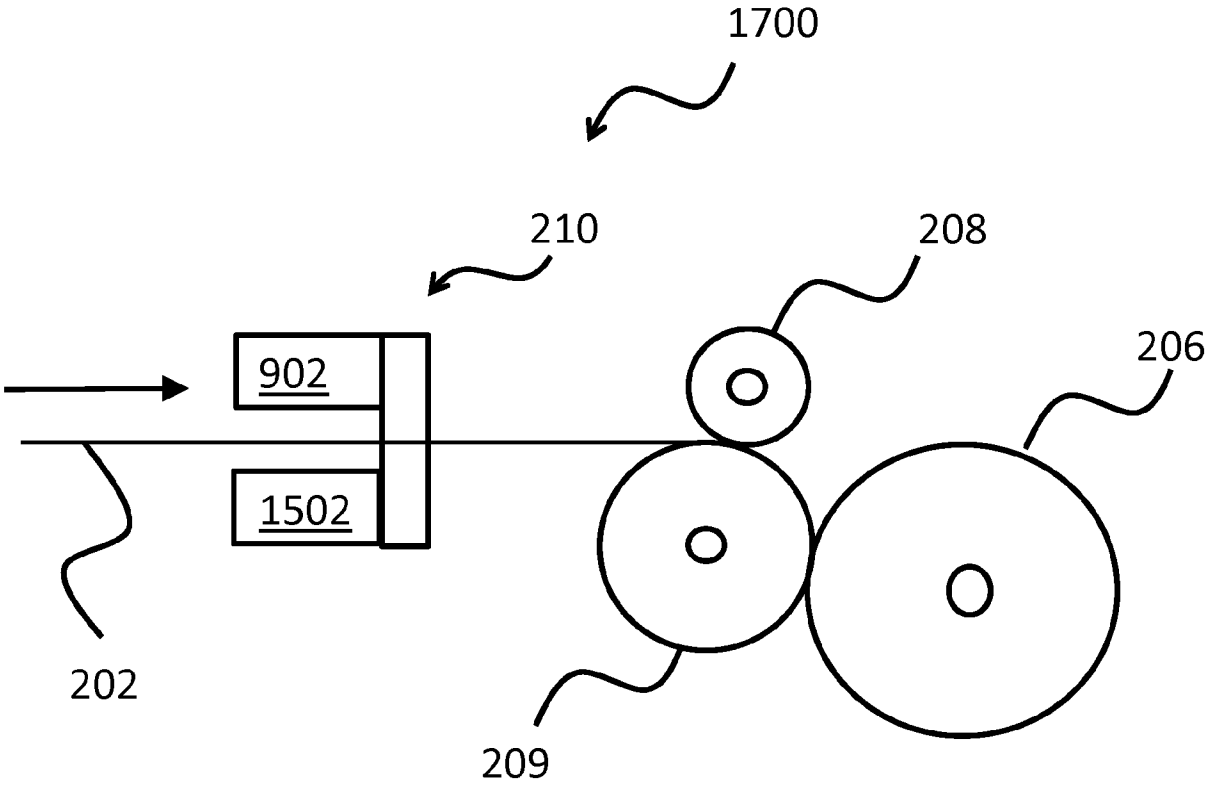
FIG. 17 presents a diagram of a paper making machine having a web turn-up cutting apparatus, an adhesive applicator for applying an adhesive on at least a portion of the middle strip and an adhesive applicator for applying an adhesive on at least a portion of the two wings, according to one embodiment.
Figure 18:
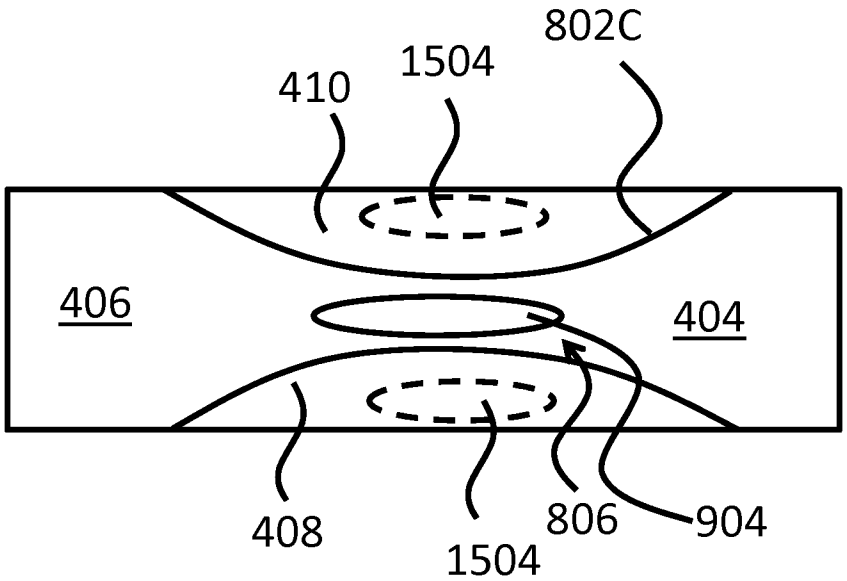
FIG. 18 presents a diagram of the severed paper of FIG. 8E with adhesive applied on an underside of at least a portion of the two wings and on at least a portion of the middle strip, according to one embodiment.

Presented in FIG. 17 according to an alternate embodiment, there is a paper making machine 1700 with the web turn-up cutting apparatus 210 comprising the the wing adhesive applicator 1502 and adhesive applicator 902 for applying adhesive on the middle strip 806. In this embodiment, the adhesive applicator 902 is positioned above and in proximity with the traveling paper web 200 for applying the adhesive 904 on an upper side of the paper web 202 and engaging the new spool 208 as concurrently presented in FIG. 18. The wind adhesive applicator 1502 is positioned under and in proximity with the traveling paper web 202 for applying the adhesive 1504 on an underside of the paper web 202 and engaging the driving drum 209 as further presented in FIG. 18.

Figure 19:
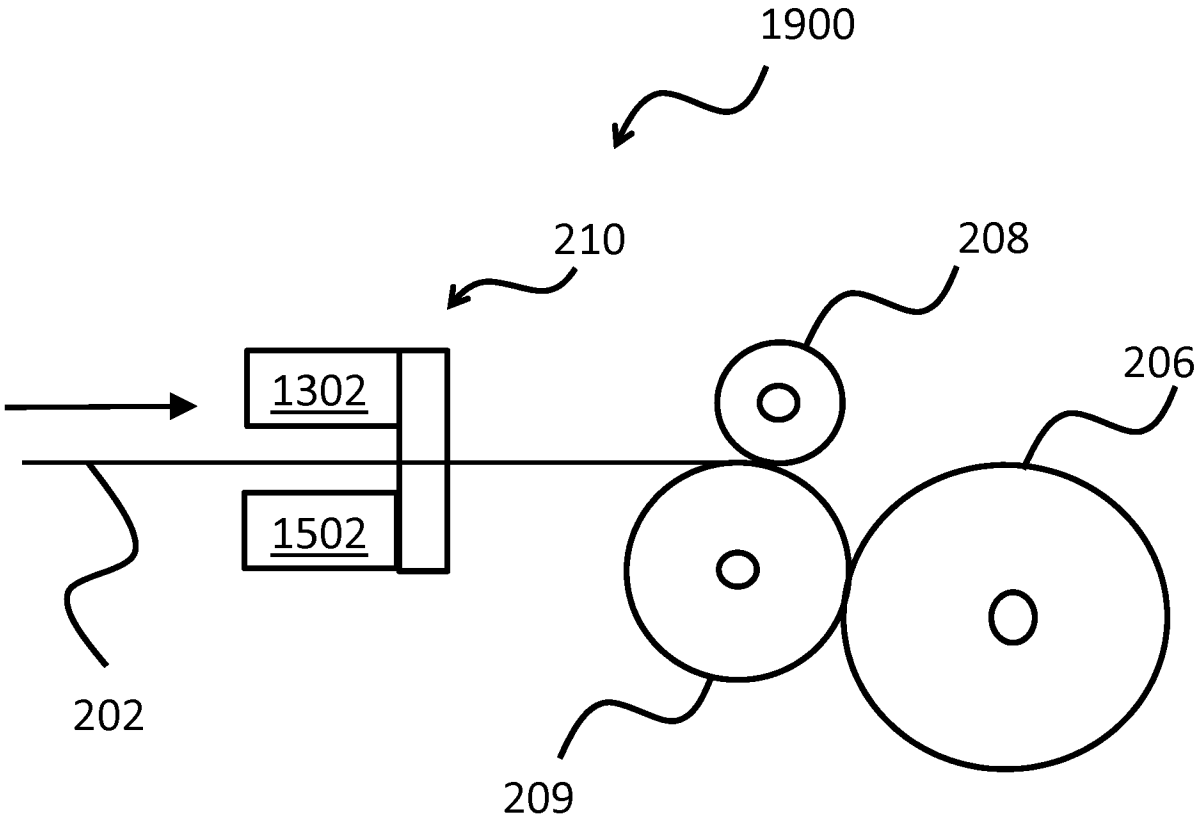
FIG. 19 presents a diagram of a paper making machine having a web turn-up cutting apparatus, an adhesive applicator for applying an adhesive on at least a portion of the substantially V-shaped start and an adhesive applicator for applying an adhesive on at least an underside portion of the two wings, according to one embodiment.
Figure 20A:
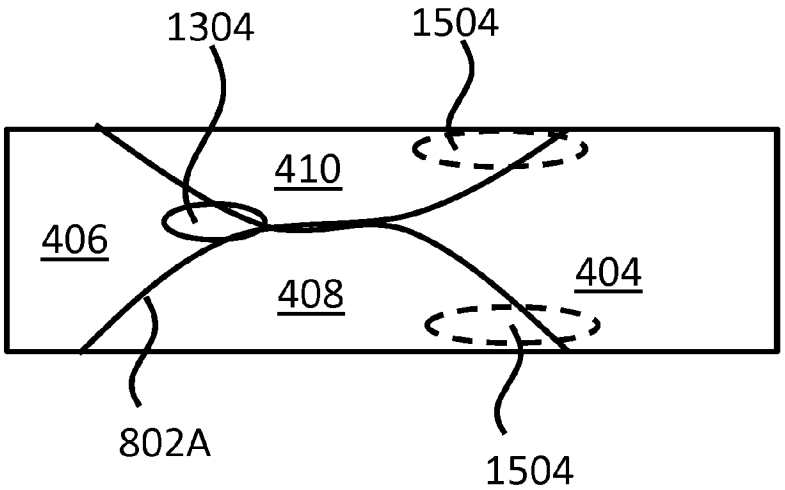
FIG. 20A presents a diagram of the severed paper of FIG. 8A with adhesive applied on an underside of at least a portion of the two wings and on at least a portion of the substantially V-shaped start, according to one embodiment.
Figure 20B:
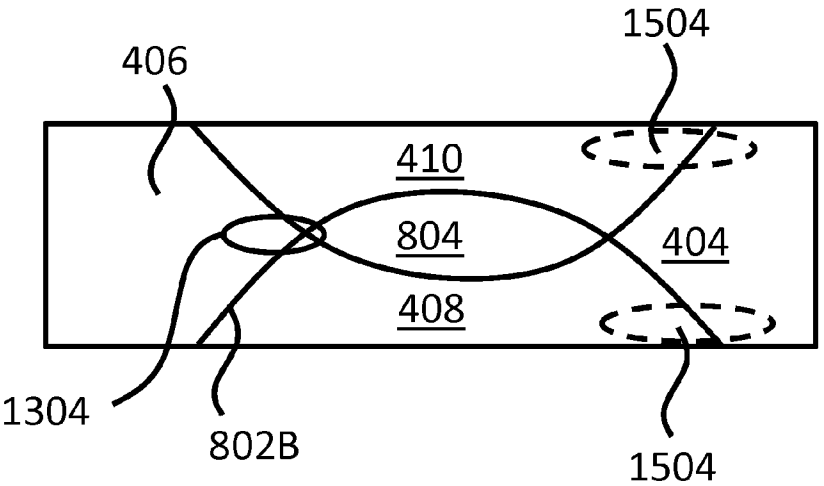
FIG. 20B presents a diagram of the severed paper of FIG. 8B with adhesive applied on an underside of at least a portion of the two wings and on at least a portion of the substantially V-shaped start, according to one embodiment.

Presented in FIG. 19 according to an alternate embodiment, there is a paper making machine 1900 with the web turn-up cutting apparatus 210 comprising the the wing adhesive applicator 1502 and adhesive applicator 1302 for applying adhesive on the substantially V-shaped start 406. The adhesive applicator 1302 is positioned above and in proximity with the traveling paper web 200 for applying the adhesive 1304 on an upper side of the paper web 202 and engaging the new spool 208 as concurrently presented in FIGS. 20A and 20B. The wind adhesive applicator 1502 is positioned under and in proximity with the traveling paper web 202 for applying the adhesive 1504 on an underside of the paper web 202 and engaging the driving drum 209 as further presented in FIGS. 20A and 20B.

In anyone of the embodiments illustrated in FIGS. 20A, 20B, 16A, 16B, 16C and 16D the adhesive applicator 1502 of FIG. 15 may be activated to apply adhesive on the very tip of the wings (408 and 410) or middle strip 804. In this case, some adhesive may be applied onto the tail 404 without departing from the scope of the present invention. Also, the adhesive applicator 1302 may be activated to apply adhesive on the very tip of the start 406. In this case some adhesive may also be applied on the wings (410 and 408) or middle strip 804 without departing from the scope of the present invention.

Figure 21A:
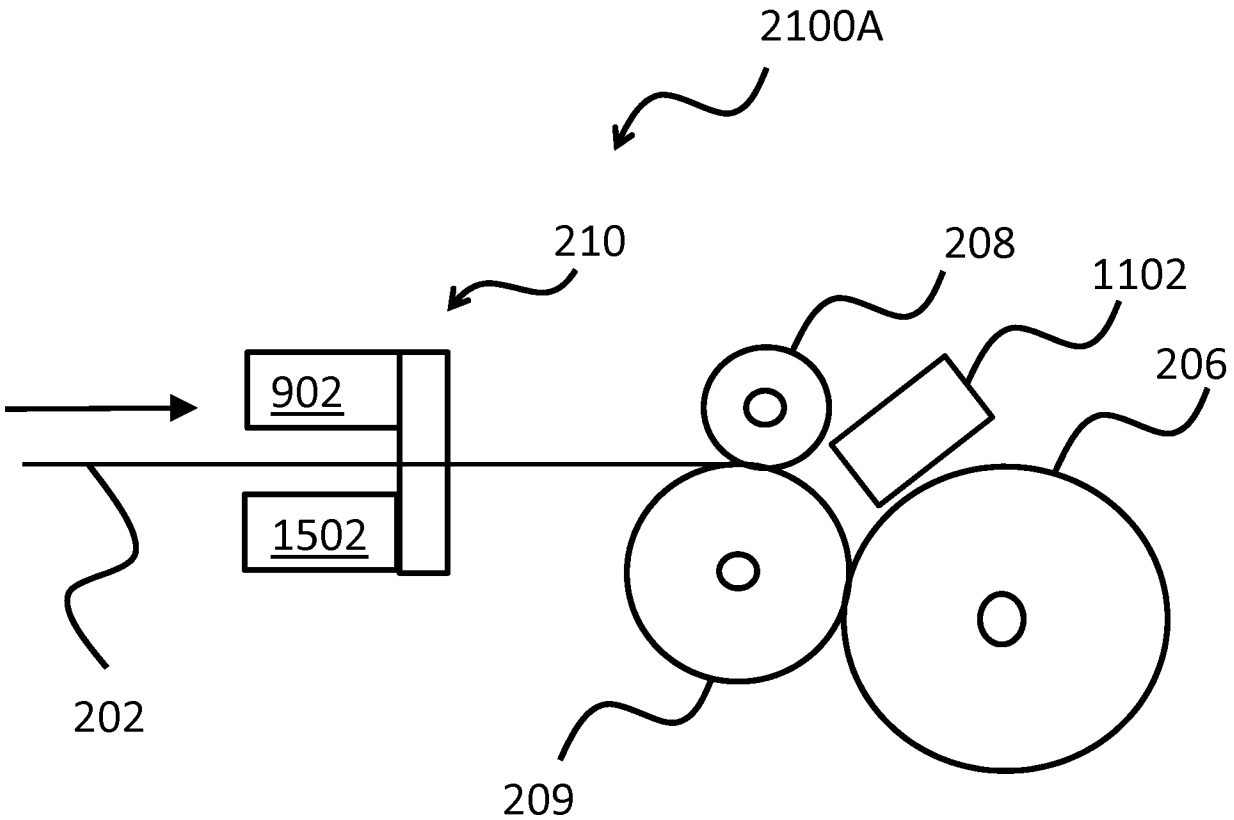
FIG. 21A presents a diagram of a paper making machine having a web turn-up cutting apparatus, an adhesive applicator for applying an adhesive on at least a portion of the middle strip, an adhesive applicator for applying an adhesive on at least an underside portion of the two wings and an adhesive applicator for applying an adhesive on at least a portion of the substantially V-shaped tail, according to one embodiment.
Figure 21B:
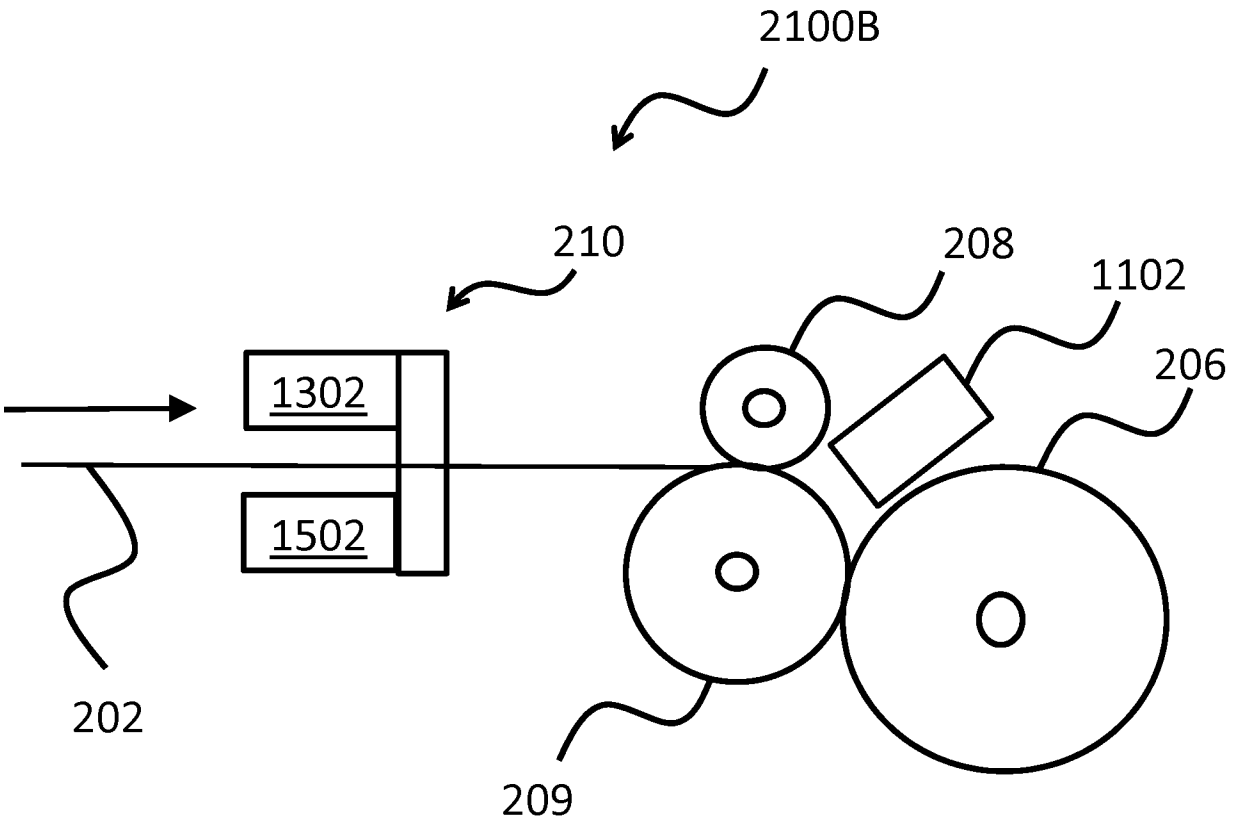
FIG. 21B presents a diagram of a paper making machine having a web turn-up cutting apparatus, an adhesive applicator for applying an adhesive on at least a portion of the substantially V-shaped start, an adhesive applicator for applying an adhesive on at least a portion of the two wings and an adhesive applicator for applying an adhesive on at least a portion of the substantially V-shaped tail, according to one embodiment.

A skilled person would understand that any of the above described paper making machine can further have the adhesive applicator 1102 for additionally applying adhesive 1104 onto the substantially V-shaped tail 404 as presented in FIG. 12 and as concurrently presented in the paper making machines 2100A and 2100*b* of FIGS. 21A and 21B.

It shall be understood that one or more of the adhesive applicators (902, 1102, 1302 and 1502) may be replaced by an electric charge applicator for electrically charging at least a part of a corresponding portion defined by the substantially X-shaped cut. The electrically charged part then being adapted to statically adhere to a respective new spool, driving drum or formed roll.

In an alternate embodiment, the adhesive applicator 1502 is replaced by the driving drum 209 defining a perforated surface for applying a controllable air suction force on the surface of the driving drum. The controllable air suction force may be activated for allowing the wings (408 and 410) or middle strip 804 to adhere on the surface of the driving drum. The controllable air suction force may further be deactivated for allowing the wings (408 and 410) or middle strip 804 to fall off from the surface of the driving drum and to fall into a collector for re-pulping.

Figure 21C:
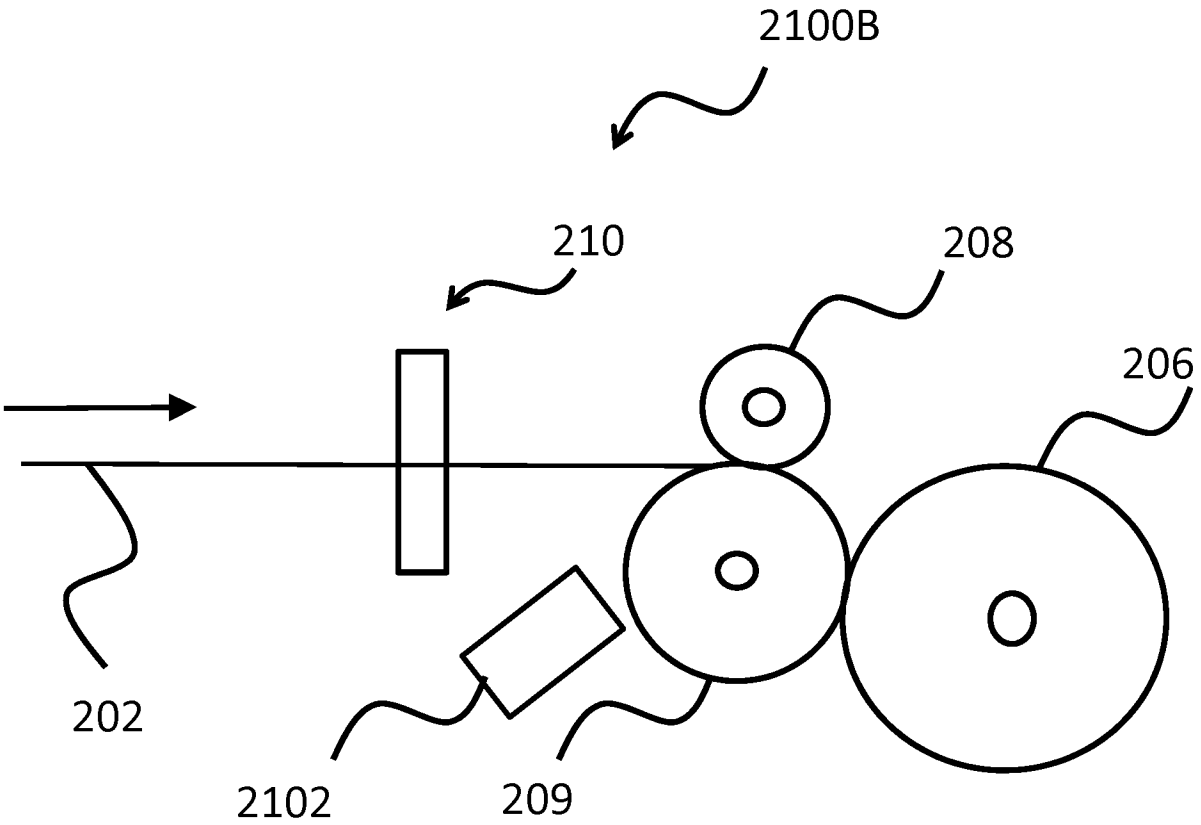

In yet another embodiment as presented in FIG. 21C, the adhesive applicator 1502 is replaced by an adhesive applicator 2102 that is adapted to apply adhesive on a surface of the driving drum for allowing the wings (408 and 410) or middle strip 804 to adhere thereon.

It shall be understood that the adhesive applicators (902, 1102, 1302 and 1502, 2102) may be adapted to apply a permanent adhesive or a non-permanent adhesive such as water or a removable sealant. Note that for re-pulping purposes, it may be required that the adhesive applicators only apply a re-pulpable adhesive.

Figure 22:
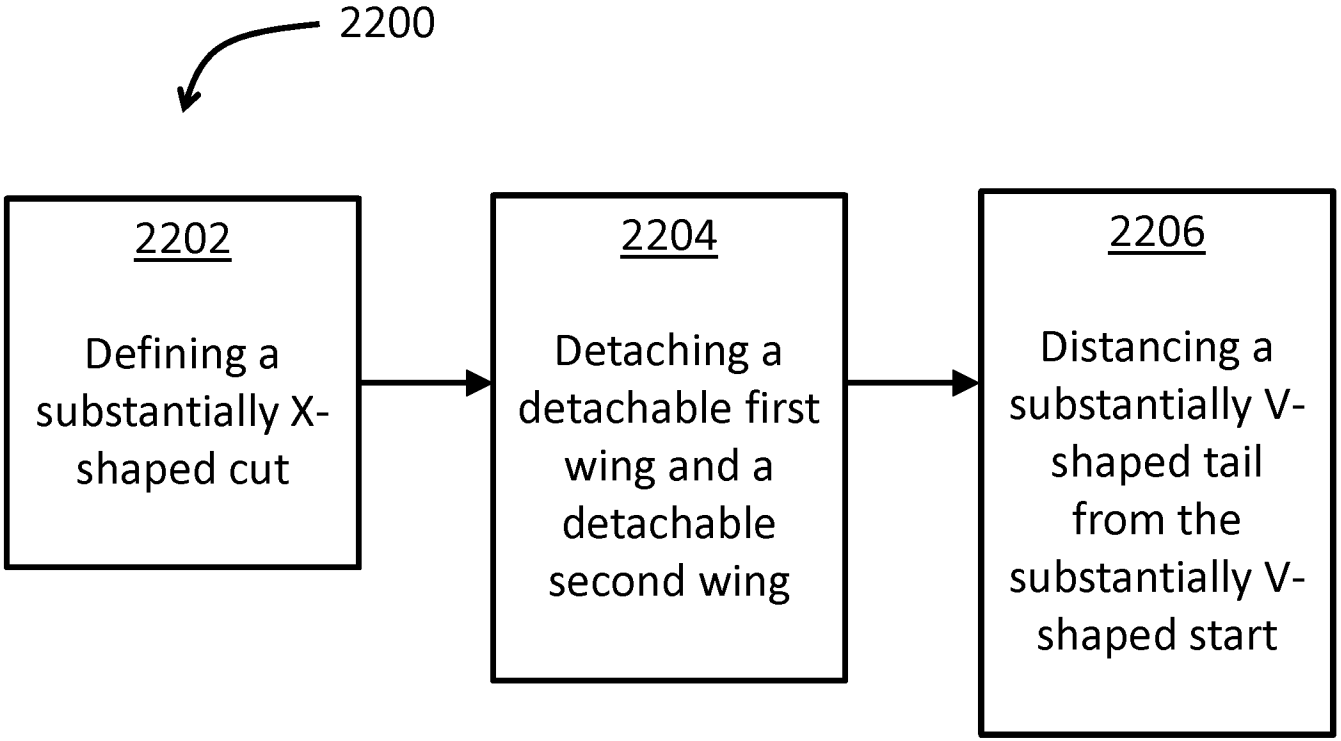
FIG. 22 presents a method of performing a turn-up in a paper making machine, according to one embodiment.

According to another aspect, there is a method of performing a turn-up in a paper making machine, as presented in FIG. 22. The method 2200 comprises defining 2202 a substantially X-shaped cut in a traveling continuous paper web 202, as described above in FIGS. 8A, 8B, 8C, 8D and 8E. It shall be understood that the defining 2202 is not restricted to the defining of the substantially X-shaped cut as previously presented and can be the defining of any suitable substantially X-shaped cut that forms at least a substantially V-shaped start 406, a substantially V-shaped tail 408, a detachable first wing 408 and a detachable second wing 410.

Figure 23:
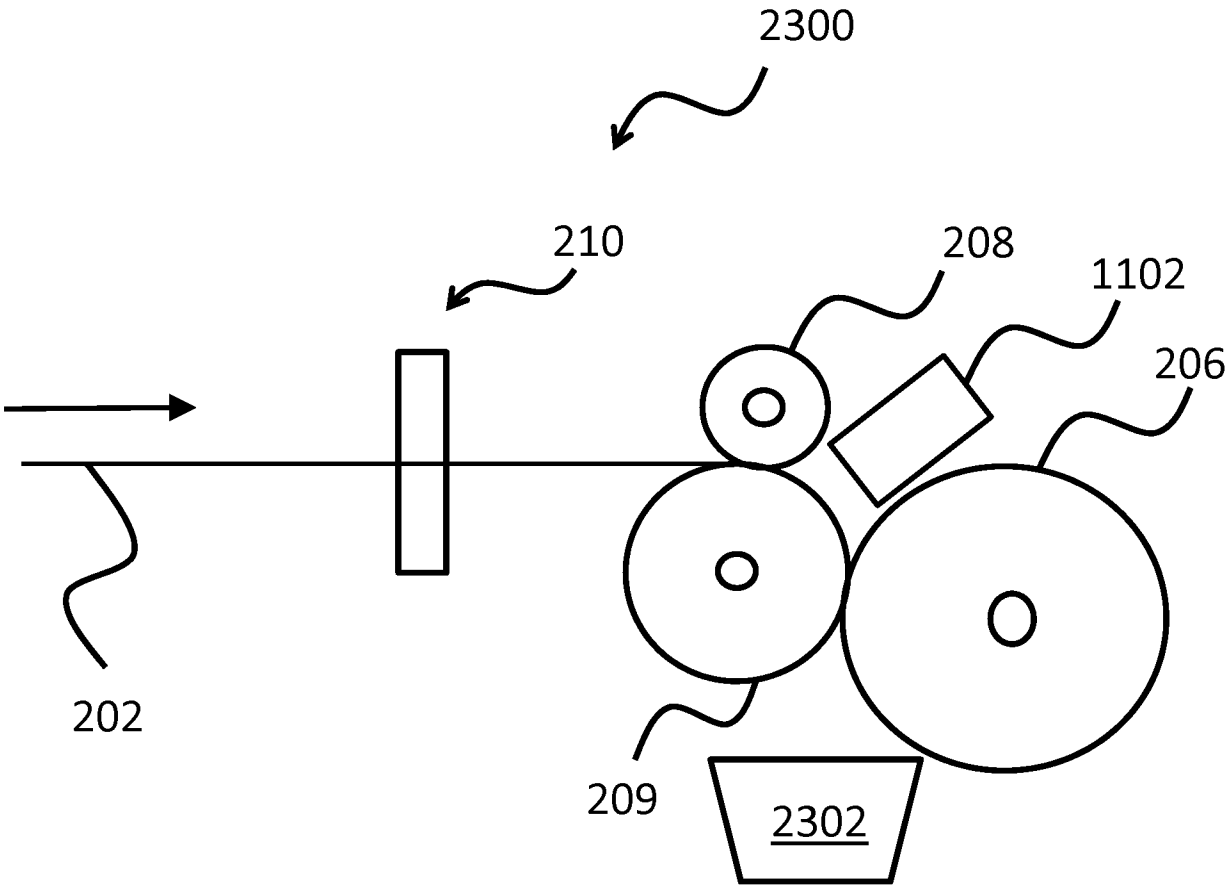
FIG. 23 presents a diagram of a paper making machine having a collector for collecting the wings, according to one embodiment.

The method further comprises detaching 2204 the detachable first wing 408 and the detachable second wing 410 from the traveling continuous paper web 202 as concurrently presented in FIGS. 8A, 8B, 8C, 8D and 8E. There are various ways of detaching the wings (408 and 410), one of the ways is to allow the wings to drop into a collector 2302 such as a bin or a chute, as in the paper making machine 2300 of FIG. 23. The dropping of the wings into the collector 2302 may be provoked by gravitational force or by any other type of force such as by a vacuum, an air blower, a fluid jet, etc.

The method further comprises distancing 2206 the substantially V-shaped tail 404 from the substantially V-shaped start 406 by allowing the substantially V-shaped start 406 to engage the new spool 208. There are various ways of distancing the substantially V-shaped tail and start (404 and 406) from each other, one way is to apply an adhesive onto the start 406 and thereby allowing the start 406 to engage the new spool 208 and wind thereon. The forming roll 206 continues to rotate and the tail 404 is wound thereon. Another way of distancing the substantially V-shaped tail and start (404 and 406) is by severing a middle strip 806 as presented in FIG. 8E. When an adhesive is applied onto the middles strip 806 as in FIG. 10, the middle strip 806 engages the new spool 208 thereby drawing the start 406 to wind around the new spool 208. As the middle strip 806 engages the new spool 208, the tail 404 is pulled away by the rotating forming roll 206 and there is severing of the tail 404 from the middle strip 806.

Figure 24:
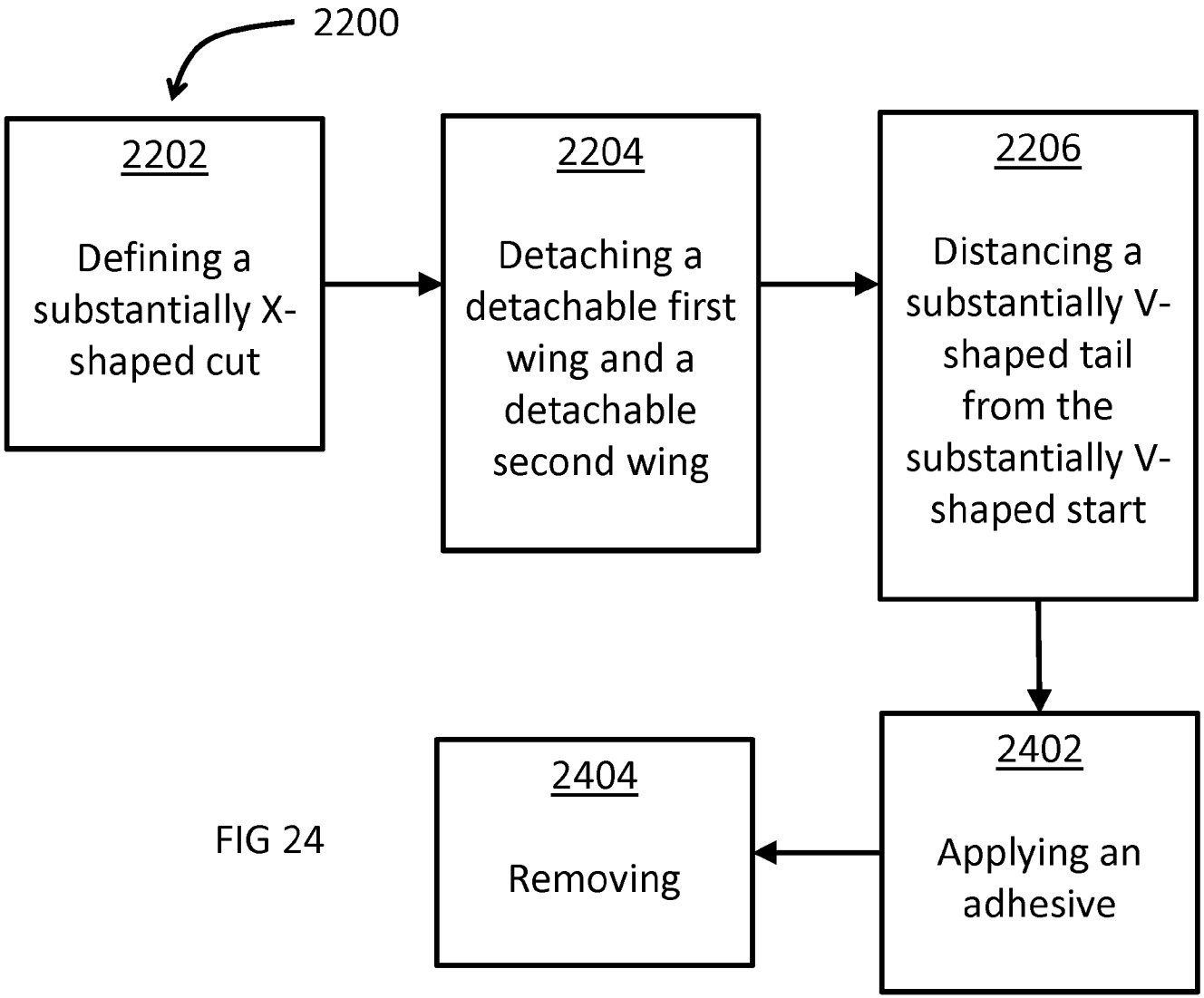
FIG. 24 presents a method of performing a turn-up in a paper making machine comprising applying an adhesive, according to one embodiment.

Presented in FIG. 24 according to one embodiment, the method 2200 further comprises applying 2402 an adhesive. The adhesive may be applied on various portions (404, 406, 408,410, 804 and 806) formed by the substantially X-shaped cut, as presented in FIGS. 8A, 8B, 8C, 8D and 8E. In one instance, the adhesive could be applied for allowing the start 406 or the middle strip 806 to engage the new spool 208. In another instance, the adhesive could be applied for allowing the tail 404 to contact a surface of the forming roll 206.

Figure 25A:
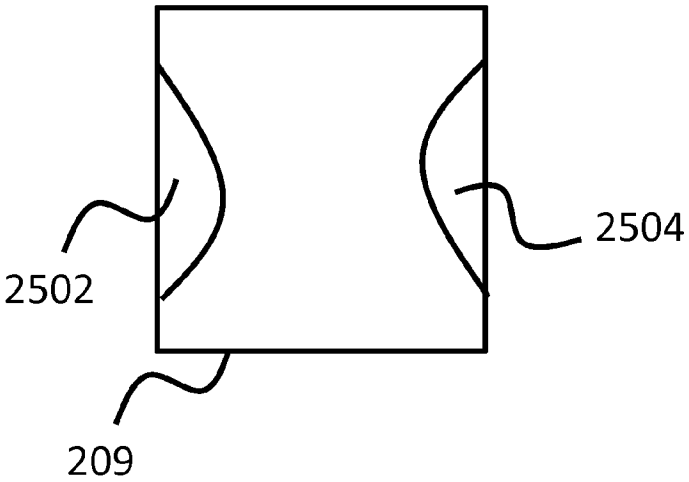
FIG. 25A presents an underside view of the driving drum whereon there is adhered the two wings, according to one embodiment.
Figure 25B:
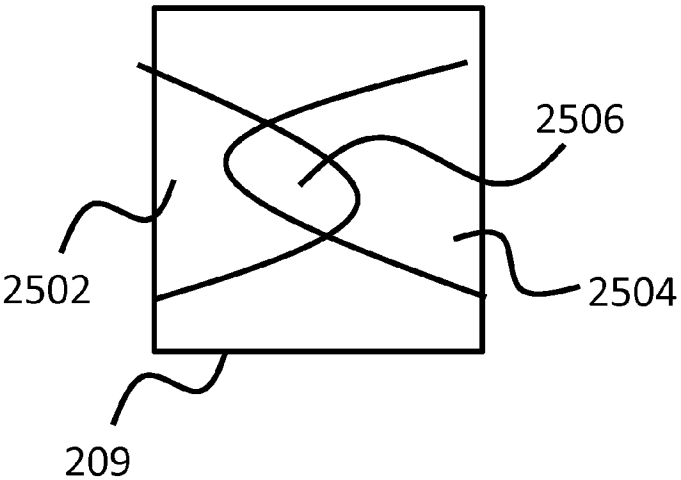
FIG. 25B presents an underside view of the driving drum whereon there is adhered the two wings and the detachable middle strip, according to one embodiment.

In yet another instance the adhesive could be applied for allowing the detachable wings (408 and 410) or the detachable middle strip 804 to engage a surface of a driving drum 209 of the papermaking machine and detach from the continuous web 202 as a respective detached first wing, a respective detached second wing and a detached middle strip, as presented in FIGS. 16A, 16B, 16C and 16D. According to one embodiment and as presented in FIG. 25A, there is a bottom view of the driving drum 209 whereon there is engaged on the surface the detached first wing 2502 and the detached second wing 2504. According to another embodiment and as presented in FIG. 25B, there is a bottom view of the driving drum 209 whereon there is engaged on the surface the detached first wing 2502, the detached second wing 2504 and the detached middle strip 2506.

It should be understood that applying 2402 an adhesive could also mean applying 2402 an electric charge for the various portions (404, 406, 408, 410, 804 and 806) formed by the substantially X-shaped cut to statically engage a respective one one of the new spool 208, formed roll 206 or driving drum 209.

When the driving drum 209 defines a controllable air suction force on its surface for allowing the wings (408 and 410) or the detachable middle strip 804 to adhere thereon, the applying 2402 an adhesive on the wings (408 and 410) or the detachable middle strip 804 could be replaced by activating the controllable air suction force on the surface of the drum 209.

Figure 26A:
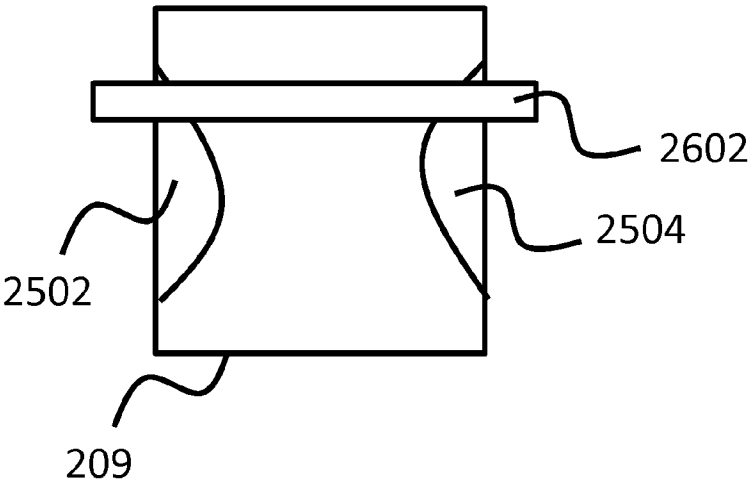
FIG. 26A presents an underside view of the driving drum and a doctor positioned in proximity with the surface of the driving drum for scrapping the two wings away from the surface of the driving drum, according to one embodiment.
Figure 26B:
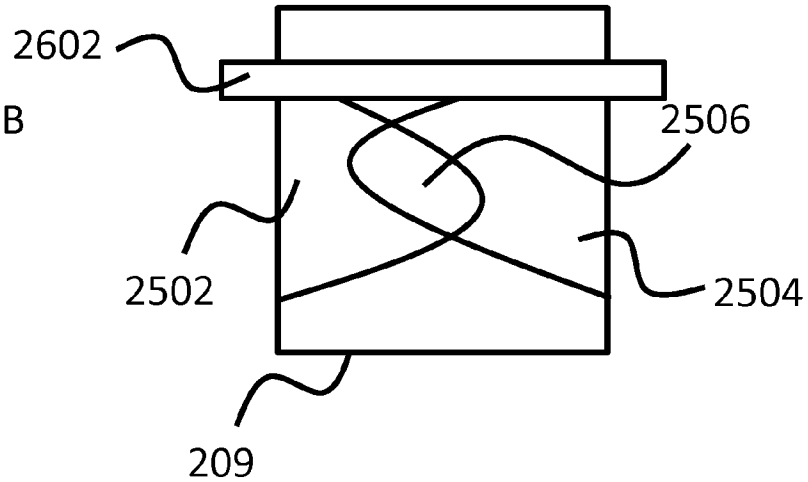
FIG. 26B presents an underside view of the driving drum and a doctor positioned in proximity with the surface of the driving drum for scrapping the two wings and the detachable middle strip away from the surface of the driving drum, according to one embodiment.

The method 2200 may further comprise removing 2404 the detached first wing 2502, the detached second wing 2504 or the detached middle strip 2506 from the surface of the driving drum 209. The removal of the detached first and second wings may be done in various ways, one way is to remove the wings by scraping a surface of the driving drum with a doctor 2602, as presented in FIGS. 26A and 26B. When the driving drum 209 defines a controllable air suction force on its surface, the removing 2404 of the detached wings may be replaced by deactivating the air suction force on the surface of the driving drum 209.

Figure 27:
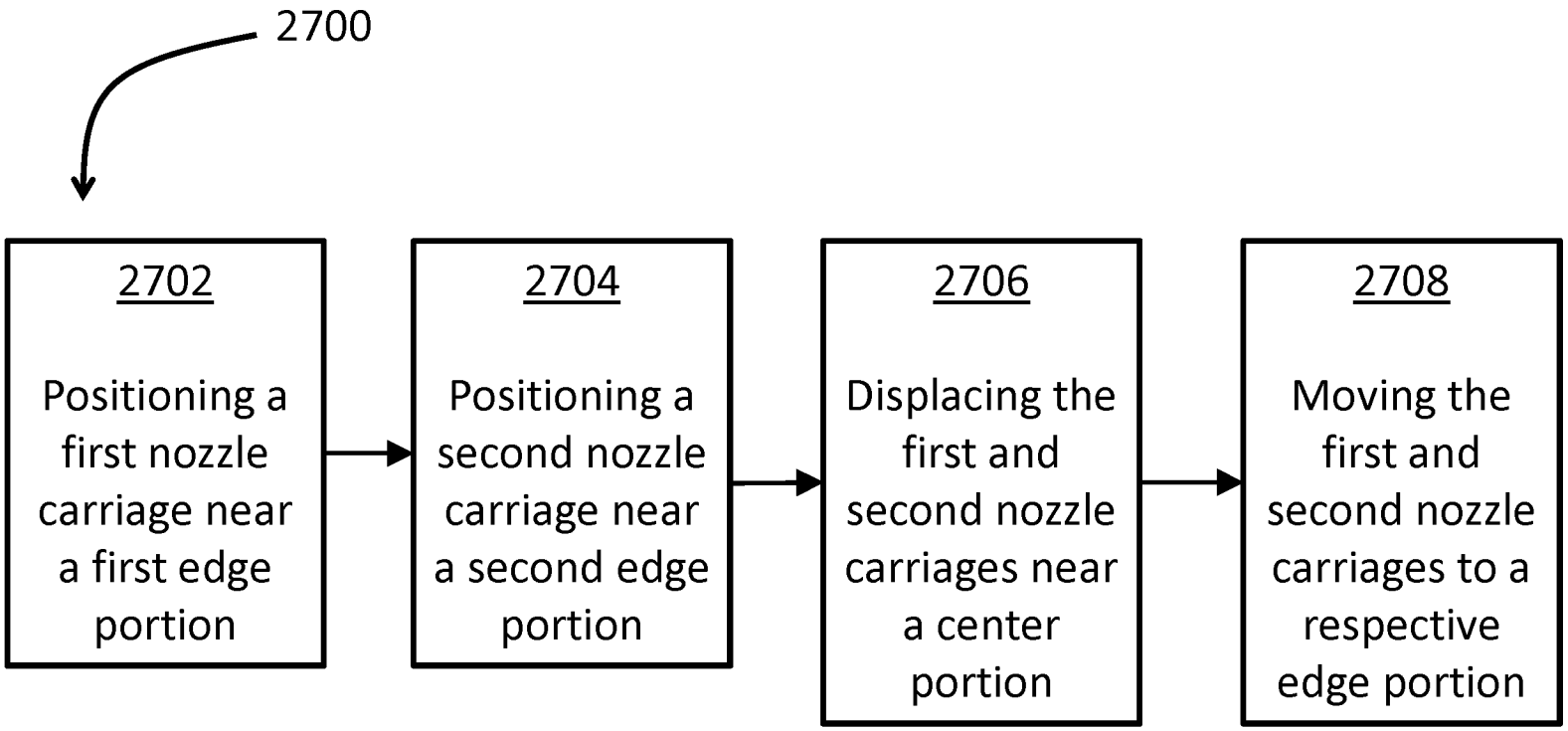
FIG. 27 presents a method of controlling the nozzle carriages in a web turn-up cutting apparatus, according to one embodiment.

According to another aspect and as presented in FIG. 27, there is a method of controlling 2700 nozzle carriages in a web turn-up cutting apparatus of a paper making machine. The nozzle carriages are adapted to provide a transversal movement to a respective first nozzle and second nozzle with respect to a traveling direction of a paper web. The method 2700 comprises positioning 2702 a first nozzle carriage 214A near a first edge portion 500A of the paper web and positioning 2704 a second nozzle carriage 214B near a second edge portion 500B of the paper web as concurrently presented in FIG. 5A.

The method 2700 further comprises displacing 2706 the first and second nozzle carriages from near the respective edge portions of the paper web to near a center portion of the paper web. When a water supply to the first and second nozzles is activated the displacing 2706 of the two carriages (214A and 214B) defines at least in-part a V-shaped tail 404 for ending a forming roll and in-part a first and second detachable wings (408 and 410), as concurrently presented in FIGS. 4 and 5A.

The method 2700 further comprises moving 2708 one of the first and second nozzle carriage from near the center portion of the paper web to near the first edge portion of the paper web and moving 2708 another one of the first and second nozzle carriage from near the center portion of the paper web to near the second edge portion of the paper web. When a water supply to the first and second nozzles is activated the moving 2708 of the two carriages (214A and 214B) defines at least in-part a V-shaped start 406 for re-threading a new spool and in-part the first and second detachable wings (408 and 410), as concurrently presented in FIGS. 4 and 5B.

In one embodiment, each carriage is adapted to move back to its respective originating edge, such as presented in FIGS. 5A and 5B. There is a single track that allows to guide the displacing 2706 and the moving back 2708 of the two carriages (214A and 214B). A single track that uses a limited amount of space may be appreciated when space is limited near the driving drum 209 as concurrently presented in FIG. 2.

In another embodiment, each carriage is adapted to cross over the width of the paper web from a respective edge to an opposite respective edge, such as presented in FIG. 6A. In paper making machines that have enough space near the driving drum 209, it is possible to have two tracks that allow to guide the displacing 2706 and the moving 2708 of the two carriages (214A and 214B).

According to another embodiment as presented in FIG. 27, the displacing 2706 of the nozzles are done so as to define at least a center portion cut line, as concurrently presented in FIGS. 8A and 8B.

In one alternative as presented in FIGS. 27 and 8A, the method 2700 comprises the displacing 2706 the first nozzle carriage and the second nozzle carriage by aligning the first nozzle carriage and the second nozzle carriage at an alignment line near the center portion of the paper web. As shown by cut-lines 802A, there is defined at least a center portion cut line and in-part the first and second detachable wings.

In another alternative as presented in FIGS. 27 and 8B, the carriages are adapted to displace the nozzles so as to define a detachable middle strip 804. There is displacing 2706 of the first nozzle carriage and the second nozzle carriage by allowing the first nozzle carriage and the second nozzle carriage to go beyond the alignment line while remaining near the center portion of the paper web. As shown by cut-lines 802B, there is defined two center portion cut lines that form the detachable middle strip 804.

In another alternative as presented in FIGS. 27 and 8E, the carriages are adapted to displace the nozzles so as to define a middle strip 806 that connects the V-shaped tail 404 and the V-shaped start 406. There is displacing 2706 of the first nozzle carriage and the second nozzle carriage by maintaining a distance between the first nozzle carriage and the second nozzle carriage near the center portion of the paper web. As shown by cut-lines 802C, there is formed a middle strip 806 that connects the V-shaped tail 404 and the V-shaped start 406.

Figure 28:
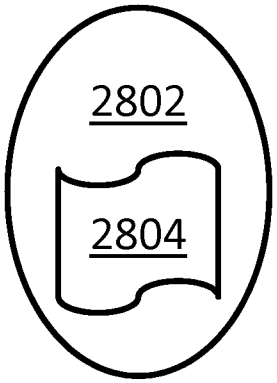
FIG. 28 presents a diagram of a machine-readable data storage medium comprising machine-executable instructions for controlling the definition of the substantially X-shaped cut, according to one embodiment.

According to another aspect as presented in FIG. 28, there is a machine-readable data storage medium 2802. The machine-readable data storage medium 2802 comprises machine-executable instructions 2804 for controlling the definition of the substantially X-shaped cut in the traveling continuous paper web of the papermaking machine, as concurrently presented in FIGS. 8A, 8B, 8C, 8D and 8E.

Figure 29:
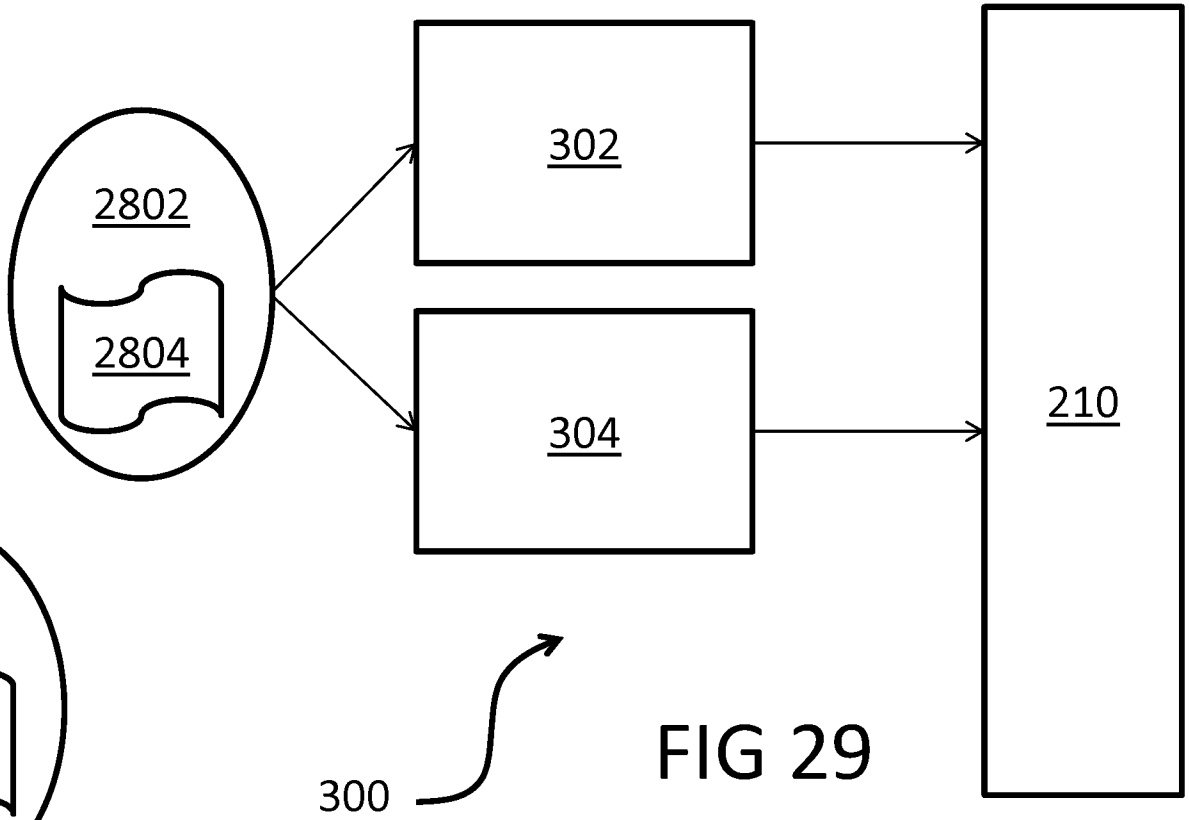
FIG. 29 presents a diagram of the data storage medium of FIG. 28 accessible by the control system of FIG. 3, according to one embodiment.

According to one embodiment as presented in FIG. 29, the data storage medium 2802 is used by the control system 300. The jet controller 302 and the carriage controller 304 are adapted to execute the machine-executable instructions 2804. In one instance, the instructions 2804 are to activate a water supply of each water supply hose to produce with the first and second nozzles (212A and 212B) a respective water cutting jet. In another instance, the instructions 2804 are to actuate the nozzle carriages (214A and 214B) to provide a transversal movement of the first and second nozzles (212A and 212B), in accordance with the method 2700 of controlling the nozzle carriages as presented in FIG. 27.

The machine readable data storage medium 2802 and the machine-executable instructions 2804 may have various forms. In one instance the, machine-executable instructions 2804 is a script for being uploaded into the controller (302 and/or 304). According to another instance, the machine-executable instructions 2804 is an upgrade to a script that is uploadable into the controller (302 and/or 304).

Figure 30:
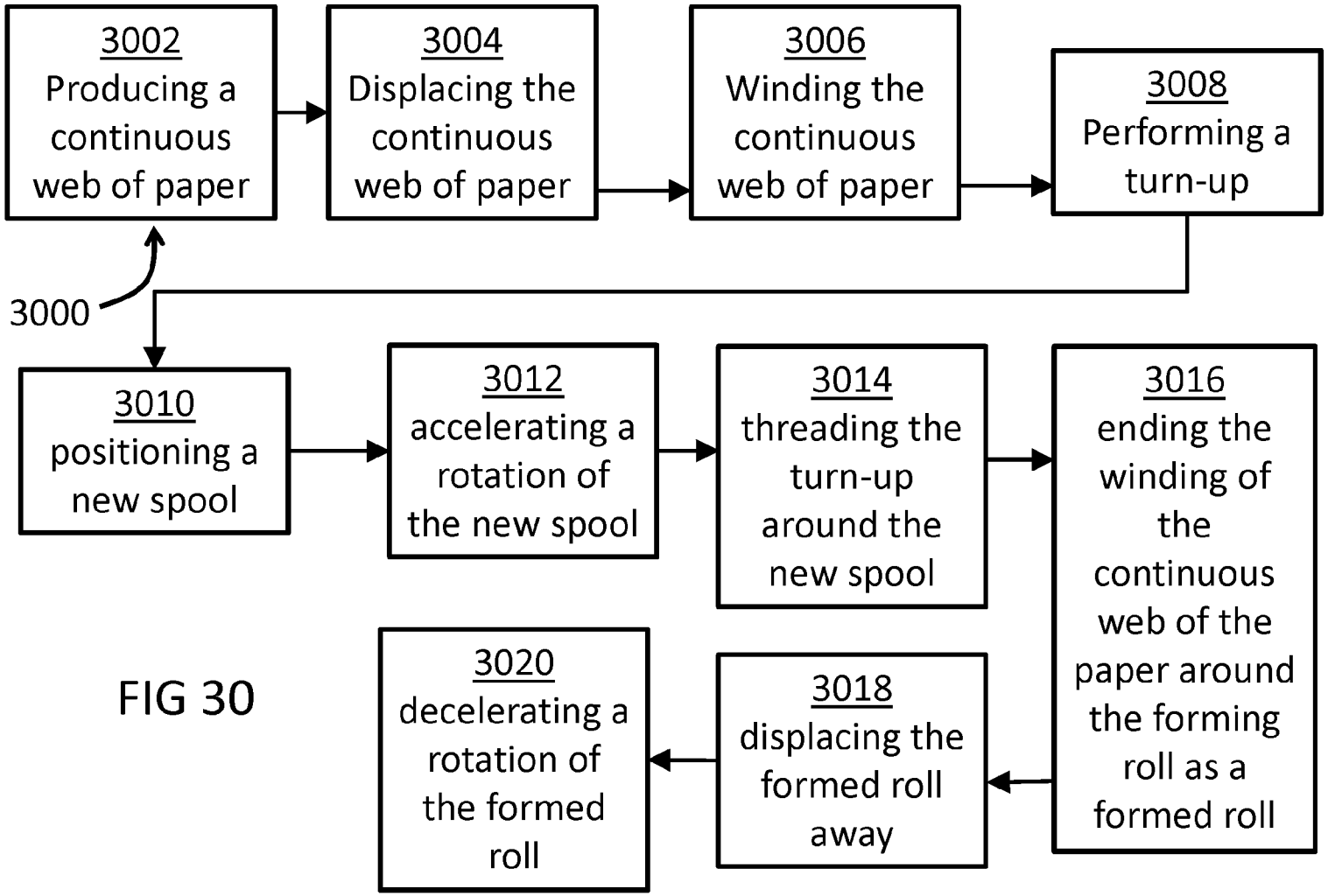
FIG. 30 presents a method of manufacturing paper in a paper making machine, according to one embodiment.

In FIG. 30, according to yet another aspect there is a method of manufacturing paper 3000 in a papermaking machine. The method 3000 comprises producing a continuous web of paper 3002, displacing the continuous web of paper 3004 in a predetermined travel direction and winding the continuous web of paper 3006 around a forming roll. The method 3000 further comprises performing a turn-up 3008 as defined above, positioning a new spool 3010 near the forming roll, accelerating a rotation of the new spool 3012 up to a winding speed and threading the turn-up around the new spool 3014. In addition, the method 3000 comprises ending the winding of the continuous web 3016 of the paper around the forming roll as a formed roll, displacing the formed roll away 3018 from the new spool and decelerating a rotation 3020 of the formed roll until a full stop.

What is claimed is:

1. A web turn-up cutting apparatus for severing a continuous web that is traveling in a travel direction, the apparatus comprising:

a first nozzle connectable to a first water supply hose and adapted to produce a first water cutting jet and a second nozzle connectable to a second water supply hose and adapted to produce a second water cutting jet, the first nozzle and the second nozzle each being mountable on respective nozzle carriages and being transversely movable with respect to the travel direction of the continuous web;

a jet controller adapted to activate a water supply of the first water supply hose for the first nozzle to produce the first water cutting jet and to activate a water supply of the second water supply hose for the second nozzle to produce the second water cutting jet; and a carriage controller adapted to actuate the nozzle carriages to provide a transversal movement of the first nozzle and of the second nozzle;

wherein the first nozzle and the second nozzle define together a substantially X-shaped cut on the traveling continuous web, the substantially X-shaped cut defining at least a substantially V-shaped tail for ending a forming roll, an opposite substantially V-shaped start for starting a new spool, a detachable first wing and a detachable second wing.

2. The web turn-up cutting apparatus of claim 1, wherein the nozzle controller is adapted to actuate the nozzle carriages to provide a transversal movement of the first nozzle and of the second nozzle from a respective edge of the continuous web to a middle portion of the continuous web and from the middle portion of the continuous web back to the respective edge of the continuous web.

3. The web turn-up cutting apparatus of claim 2, wherein the second nozzle is positioned upstream from the first nozzle and wherein the nozzle controller is adapted to actuate the nozzle carriages to provide a transversal movement of the first nozzle and of the second nozzle for creating respectively a first cut line and a second cut line that cross in the middle portion of the continuous web, thereby forming a detachable middle strip.

4. The web turn-up cutting apparatus of claim 2, wherein the nozzle controller is adapted to actuate the nozzle carriages to provide a transversal movement of the first nozzle and of the second nozzle for creating respectively a first cut line and a second cut line that join in the middle portion of the continuous web.

5. The web turn-up cutting apparatus of claim 2, wherein the nozzle controller is adapted to actuate the nozzle carriages to provide a transversal movement of the first nozzle and of the second nozzle for creating respectively a first cut line and a second cut line that remain separate in the middle portion of the continuous web, thereby forming a middle strip connecting the substantially V-shaped tail and the substantially V-shaped start.

6. The web turn-up cutting apparatus of claim 1, wherein the second nozzle is positioned upstream from the first nozzle and wherein the nozzle controller is adapted to actuate the nozzle carriages to provide a transversal movement of the first nozzle from a first edge of the continuous web to a second edge of the continuous web and of the second nozzle from the second edge of the continuous web to the first edge of the continuous web.

7. The web turn-up cutting apparatus of claim 1, further comprising a first adhesive applicator that is adapted to apply an adhesive on at least a portion of the substantially V-shaped tail and allow the V-shaped tail to adhere on a winding surface of the forming roll as the substantially V-shaped tail is wound thereon.

8. The web turn-up cutting apparatus of claim 1, further comprising a second adhesive applicator that is adapted to apply an adhesive on at least a portion of the first and the second detachable wings and allow the first and second detachable wings to engageably adhere to a driving drum of the papermaking machine and detach from the continuous paper web.

9. The web turn-up cutting apparatus of claim 7, wherein the first adhesive applicator is further adapted to apply an adhesive on at least a portion of the substantially V-shaped start and allow the V-shaped start to adhere on a winding surface of the new spool as the substantially V-shaped start is wound thereon.

10. The web turn-up cutting apparatus of claim 5, further comprising a first adhesive applicator that is adapted to apply an adhesive on at least a portion of the middle strip and allow the at least portion of the middle strip to adhere on a winding surface of the new spool thereby causing the substantially V-shaped tail to sever from the continuous paper web for ending the forming roll.

11. The web turn-up cutting apparatus of claim 1, wherein the carriage controller is adapted to actuate the nozzle carriages to provide a transversal movement of the first nozzle and of the second nozzle, whereby the first nozzle and the second nozzle define together the substantially X-shaped cut on the traveling continuous web in less than 3 seconds.

12. The web turn-up cutting apparatus of claim 1, wherein the carriage controller is adapted to actuate each of the nozzle carriages from an initial position to a final position for defining with the first nozzle and the second nozzle the substantially X-shaped cut, wherein the final position is a subsequent initial position for performing a subsequent substantially X-shaped cut.

13. A method of controlling a first nozzle carriage and a second nozzle carriage in a web turn-up cutting apparatus of a papermaking machine, each of the first and second nozzle carriages being adapted to provide a transversal movement to a respective first nozzle and second nozzle with respect to a traveling direction of a paper web, the method comprising:

positioning the first nozzle carriage near a first edge portion of the paper web;

positioning the second nozzle carriage near a second edge portion of the paper web;

displacing the first nozzle carriage from near the first edge portion of the paper web to near a center portion of the paper web and defining at least in-part a V-shaped tail for ending a forming roll and in-part a first detachable wing, when a water supply to the first nozzle is activated;

displacing the second nozzle carriage from near the second edge portion of the paper web to near a center portion of the paper web and defining at least in-part the V-shaped tail and in-part a second detachable wing, when a water supply to the second nozzle is activated;

moving one of the first and second nozzle carriage from near the center portion of the paper web to near the first edge portion of the paper web and defining at least in-part a V-shaped start for re-threading a new spool and in-part one of the first and second detachable wings, when a water supply to the respective nozzle is activated; and moving another one of the first and second nozzle carriage from near the center portion of the paper web to near the second edge portion of the paper web and defining at least in-part the V-shaped start end and in-part another one of the first and second detachable wings, when a water supply to the respective nozzle is activated.

14. The method of claim 13, wherein the moving one of the first and second nozzle carriage is moving of the first nozzle carriage from near the center portion of the paper web to near the first edge portion of the paper web and the moving another one of the first and second nozzle carriage is the moving of the second nozzle carriage from near the center portion of the paper web to near the second edge portion of the paper web.

15. The method of claim 13, wherein the moving one of the first and second nozzle carriage is moving of the second nozzle carriage from near the center portion of the paper web to near the first edge portion of the paper web and the moving another one of the first and second nozzle carriage is moving of the first nozzle carriage from near the center portion of the paper web to near the second edge portion of the paper web.

16. The method of claim 14, wherein the displacing the first nozzle carriage and the second nozzle carriage comprises aligning the first nozzle carriage and the second nozzle carriage at an alignment line near the center portion of the paper web, thereby defining at least a center portion cut line and in-part the first and second detachable wings.

17. The method of claim 15, wherein the displacing the first nozzle carriage and the second nozzle carriage further comprises displacing the first nozzle carriage and the second nozzle carriage beyond the alignment line while remaining near the center portion of the paper web, thereby defining two center portion cut lines and forming a detachable middle strip.

18. The method of claim 13, wherein the displacing the first nozzle carriage and the second nozzle carriage comprises maintaining a distance between the first nozzle carriage and the second nozzle carriage near the center portion of the paper web, thereby forming a middle strip that connects the V-shaped tail and the V-shaped start.

19. A machine-readable data storage medium comprising machine-executable instructions for controlling a definition of a substantially X-shaped cut in a traveling continuous paper web of a papermaking machine, the substantially X-shaped cut forming at least a substantially V-shaped tail for ending a forming roll, an opposite substantially V-shaped start for starting a new spool, a detachable first wing and a detachable second wing.

* * * * *